US010141674B2

(12) United States Patent
Scanzillo et al.

(10) Patent No.: US 10,141,674 B2
(45) Date of Patent: Nov. 27, 2018

(54) TAMPER RESISTANT MECHANISM FOR ELECTRICAL WIRING DEVICES

(71) Applicant: Hubbell Incorporated, Shelton, CT (US)

(72) Inventors: Thomas L. Scanzillo, Monroe, CT (US); Edward Bazayev, Kew Gardens, NY (US); Jason Zachary Walker, Bethany, CT (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/619,329

(22) Filed: Jun. 9, 2017

(65) Prior Publication Data

US 2017/0358886 A1 Dec. 14, 2017

Related U.S. Application Data

(60) Provisional application No. 62/347,775, filed on Jun. 9, 2016.

(51) Int. Cl.
*H01R 13/44* (2006.01)
*H01R 13/453* (2006.01)

(52) U.S. Cl.
CPC ..... *H01R 13/453* (2013.01)

(58) Field of Classification Search
CPC ..... H01R 13/447; H01R 13/4532; H01R 13/4534
USPC ..... 439/138, 135, 145
See application file for complete search history.

(56) References Cited

U.S. PATENT DOCUMENTS

| | | | | |
|---|---|---|---|---|
| 1,275,690 | A | 8/1918 | Hubbell | |
| 3,990,758 | A | 11/1976 | Petterson | |
| 4,544,219 | A | 10/1985 | Barkas | |
| 4,722,693 | A | 2/1988 | Rose | |
| 4,780,793 | A | 10/1988 | Ohtsuki | |
| 5,006,075 | A | 4/1991 | Bowden, Jr. | |
| 5,020,997 | A | 6/1991 | Calderara et al. | |
| 5,095,182 | A * | 3/1992 | Thompson | H01R 13/7036 200/43.04 |
| 5,244,398 | A | 9/1993 | Chou | |
| 5,267,870 | A | 12/1993 | Maresh | |
| 5,277,602 | A | 1/1994 | Yi | |
| 5,281,156 | A | 1/1994 | Yi | |
| 5,320,545 | A | 6/1994 | Brothers | |
| 5,915,981 | A | 6/1999 | Mehta | |
| 5,998,735 | A | 12/1999 | Patterson, Jr. | |
| 6,056,564 | A | 5/2000 | Huang | |

(Continued)

FOREIGN PATENT DOCUMENTS

CA 2650745 8/2009

OTHER PUBLICATIONS

International Search Report and Written Opinion mailed in corresponding International Application PCT/US17/36874 dated Aug. 22, 2017.

*Primary Examiner* — Phuong Dinh
(74) *Attorney, Agent, or Firm* — Wissing Miller LLP

(57) ABSTRACT

Tamper resistant cartridges for electrical devices are provided. The tamper resistant cartridges include a housing and one or more tamper resistant assemblies configured to normally block access to electrical contacts with the electrical device, and to permit access to such electrical contacts when the line phase prongs of a plug are inserted into the electrical device.

20 Claims, 28 Drawing Sheets

(56) References Cited

U.S. PATENT DOCUMENTS

| | | | | |
|---|---|---|---|---|
| 6,086,391 | A | 7/2000 | Chiu | |
| 6,111,210 | A | 8/2000 | Allison | |
| 6,217,353 | B1 | 4/2001 | Yu-Tse | |
| 6,229,107 | B1 | 5/2001 | Flint et al. | |
| 6,238,224 | B1 | 5/2001 | Shao | |
| 6,299,487 | B1 | 10/2001 | Lopata et al. | |
| 6,422,880 | B1 | 7/2002 | Chiu | |
| 6,537,088 | B2 | 3/2003 | Huang | |
| 6,555,771 | B2 | 4/2003 | Shao | |
| 6,749,449 | B2 | 6/2004 | Mortun et al. | |
| 6,776,630 | B1 | 8/2004 | Huang | |
| 6,786,745 | B1 | 9/2004 | Huang | |
| 6,893,275 | B2 | 5/2005 | Ng et al. | |
| 6,932,631 | B2 | 8/2005 | Huang | |
| 7,090,520 | B2 | 8/2006 | Matsukawa et al. | |
| 7,114,968 | B2 | 10/2006 | Healy | |
| 7,179,992 | B1 | 2/2007 | Packard et al. | |
| 7,214,101 | B1 | 5/2007 | Tong | |
| 7,312,394 | B1 | 12/2007 | Weeks et al. | |
| 7,312,963 | B1 | 12/2007 | Radosavljevic et al. | |
| 7,355,117 | B2 | 4/2008 | Castaldo et al. | |
| 7,438,567 | B2 | 10/2008 | Nalwad et al. | |
| 7,452,221 | B1 | 11/2008 | Oddsen et al. | |
| 7,455,538 | B2 | 11/2008 | Germain | |
| 7,510,412 | B1 * | 3/2009 | Valentin | H01R 13/4534 439/137 |
| 7,527,508 | B1 | 5/2009 | Lee et al. | |
| 7,551,047 | B2 | 6/2009 | Sokolow et al. | |
| 7,556,513 | B2 | 7/2009 | Ng et al. | |
| 7,558,447 | B2 | 9/2009 | Ni | |
| 7,595,449 | B1 | 9/2009 | Dyderski | |
| 7,637,756 | B1 | 12/2009 | Hsu | |
| 7,642,457 | B2 | 1/2010 | Weeks et al. | |
| 7,645,148 | B2 | 1/2010 | Carbone et al. | |
| 7,645,149 | B2 | 1/2010 | Carbone et al. | |
| 7,651,347 | B2 | 1/2010 | Germain et al. | |
| 7,868,719 | B2 | 1/2011 | Bazayev | |
| 7,883,346 | B2 * | 2/2011 | Huang | H01R 24/78 439/140 |
| 8,044,299 | B2 | 10/2011 | Weeks | |
| 8,105,094 | B2 | 1/2012 | Patel et al. | |
| 8,353,711 | B2 | 1/2013 | Huang et al. | |
| 8,672,695 | B2 | 3/2014 | Baldwin et al. | |
| 9,196,995 | B2 | 11/2015 | Scanzillo | |
| 9,478,892 | B2 | 10/2016 | Scanzillo et al. | |
| 2008/0156512 | A1 * | 7/2008 | Castaldo | H01R 13/4534 174/53 |
| 2008/0248662 | A1 | 10/2008 | Bazayev et al. | |
| 2009/0227131 | A1 | 9/2009 | Carbone et al. | |
| 2009/0236115 | A1 | 9/2009 | Li | |
| 2009/0023304 | A1 | 10/2009 | Gerard | |
| 2009/0286411 | A1 | 11/2009 | Bazayev et al. | |
| 2009/0311892 | A1 | 12/2009 | Weeks | |
| 2010/0041259 | A1 | 2/2010 | Ni | |
| 2010/0130053 | A1 | 5/2010 | Ziobro | |
| 2011/0136358 | A1 | 6/2011 | Zhang | |
| 2011/0229094 | A1 | 9/2011 | Isenhour et al. | |
| 2014/0065862 | A1 | 3/2014 | Tomimbang | |
| 2014/0162479 | A1 | 6/2014 | Baldwin et al. | |
| 2015/0064944 | A1 | 3/2015 | Scanzillo et al. | |
| 2015/0180154 | A1 | 6/2015 | Scanzillo | |

* cited by examiner

TAMPER RESISTANT MECHANISM FOR ELECTRICAL WIRING DEVICES

CROSS REFERENCE TO RELATED APPLICATIONS

The present application is based on and claims benefit from U.S. Provisional Application Ser. No. 62/347,775 filed Jun. 9, 2016 entitled "Tamper Resistant Mechanism for Electrical Receptacles" the entire contents of which are herein incorporated by reference.

BACKGROUND

Field

The present disclosure relates to electrical devices that normally block objects from passing through openings in the electrical device leading to active electrical contacts, and selectively permit prongs of a plug to pass through openings in the electrical device to contact the active electrical contacts. More particularly, the present disclosure relates to electrical receptacles that normally block objects from passing through prong openings in the receptacle and selectively permit prongs of a plug to pass through openings in the receptacle so that electrical power can be supplied to the plug.

Description of the Related Art

Electrical devices, and specifically electrical receptacles, are capable of receiving electrical plugs to provide electricity to the electrical plug and are well known. In the United States, standard residential electrical receptacles generally include two or three prong openings. Two prong opening electrical receptacles can receive two prong electrical plugs, and three prong opening electrical receptacles can receive two prong electrical plugs or three prong electrical plugs. Electrical receptacles are generally active, meaning they provide electricity to contacts within the electrical receptacle at all times. Thus, children and even some adults are susceptible to being shocked in the event that an electrically conductive object is inserted into an electrical receptacle prong opening. Conductive objects may include knives, paper clips, screw drivers, or the like that a person may insert into the prong opening.

One attempt to alleviate the potential risk of a person inadvertently inserting a conductive object into a prong opening of an electrical receptacle involves a complex door mechanism in the electrical receptacle that must be overcome before the object can reach electrical contacts within the electrical receptacle, which often frustrates users. Other attempts to alleviate the potential risk of a person inadvertently inserting a conductive object into a prong opening of an electrical receptacle involve less complex mechanisms that are often very cumbersome to operate also frustrating users.

SUMMARY

The present disclosure describes embodiments of tamper resistant cartridges for electrical devices. The tamper resistant cartridges include a housing and one or more tamper resistant assemblies configured to normally block access to electrical contacts with the electrical device, and to permit access to such electrical contacts when the line phase prongs of a plug are inserted into the electrical device. In another exemplary embodiment, the tamper resistant cartridge includes a housing and a tamper resistant assembly. The housing has a first opening that permits a first blade of a plug to pass into the housing and a second opening aligned with the first opening that permits the first blade to pass through the housing. The housing also includes third opening that permits a second blade of a plug to pass into the housing and a fourth opening aligned with the third opening that permits the second blade to pass through the housing. The tamper resistant assembly is positioned within the housing and between the first opening and the second opening, and between the third opening and the fourth opening. The tamper resistant assembly is normally in a blocking position that prevents the first blade from passing through the second opening and the second blade from passing through the fourth opening unless the first blade is inserted into the first opening at substantially the same time as the second blade is inserted into the third opening. The tamper resistant assembly comprises a first shutter assembly positioned to block the first opening and a second shutter assembly positioned to block the third opening, a first slider positioned to block the second opening and a second slider positioned to block the fourth opening. The first shutter assembly is interrelated with the second shutter assembly such that when each shutter assembly is activated at substantially the same time the first and second sliders move to a position where the second and fourth openings are not blocked such that access through the housing is permitted.

The present disclosure also describes embodiments of electrical devices, such as receptacles, that normally block objects from passing through openings in the electrical device leading to active electrical contacts, and selectively permit prongs of a plug to pass through openings in the electrical device to contact the active electrical contacts. In one exemplary embodiment, the electrical device is an electrical receptacle having a base, a cover and at least one tamper resistant cartridge. The base has a plurality of connector members capable of supplying electrical power. The cover has a plurality of line phase prong slots aligned with the plurality of connector members. The at least one tamper resistant cartridge is disposed between the plurality of line phase prong slots and the plurality of connector members. The at least one tamper resistant cartridge normally blocks access from the plurality of line phase prong slots to the plurality of connector members except when the line phase prongs of a plug are inserted into the plurality of line phase prong slots at substantially the same time.

BRIEF DESCRIPTION OF THE DRAWINGS

Embodiments of the invention are described in detail below, purely by way of example, with reference to the accompanying drawing figures, in which.

DETAILED DESCRIPTION

The present disclosure provides embodiments of tamper resistant cartridges that can be positioned between a cover of an electrical device and active contacts, e.g., line phase contacts, within the electrical device to block access to the active contacts and to selectively permit access to the active contacts when the prongs of a plug are properly inserted into the electrical device. The present disclosure also provides embodiments of electrical devices, e.g., electrical receptacles, with the tamper resistant cartridge.

The electrical devices contemplated by the present disclosure include electrical devices that supply power to electrical loads where electrical contacts or prongs can be inserted into the electrical device to connect to a power source. Examples of such electrical devices include receptacles that have horizontal prong openings, and receptacles that have a T-shaped prong opening and a horizontal prong opening. Generally, the openings or slots in the cover of the receptacle define the type of receptacle. It should be noted that receptacles with horizontal openings or slots described herein are generally associated with NEMA 6-15 class electrical receptacles which relates to 15 amp, 250 volt rated receptacles. Receptacles with a T-shaped opening or slot and a horizontal opening or slot described herein are generally associated with NEMA 6-20 class electrical receptacles which relates to 15 and 20 amp, 250 volt rated receptacles. While the receptacles described herein are generally associated with certain NEMA class electrical receptacles, the present disclosure is not limited to any particular NEMA class of electrical devices. Receptacles contemplated by the present disclosure include for example, single receptacles, seen in FIGS. 1, 16 and 24, or duplex receptacles, seen in FIGS. 2, 15 and 25, or receptacles on power cords, seen in FIG. 3.

Figure 1:
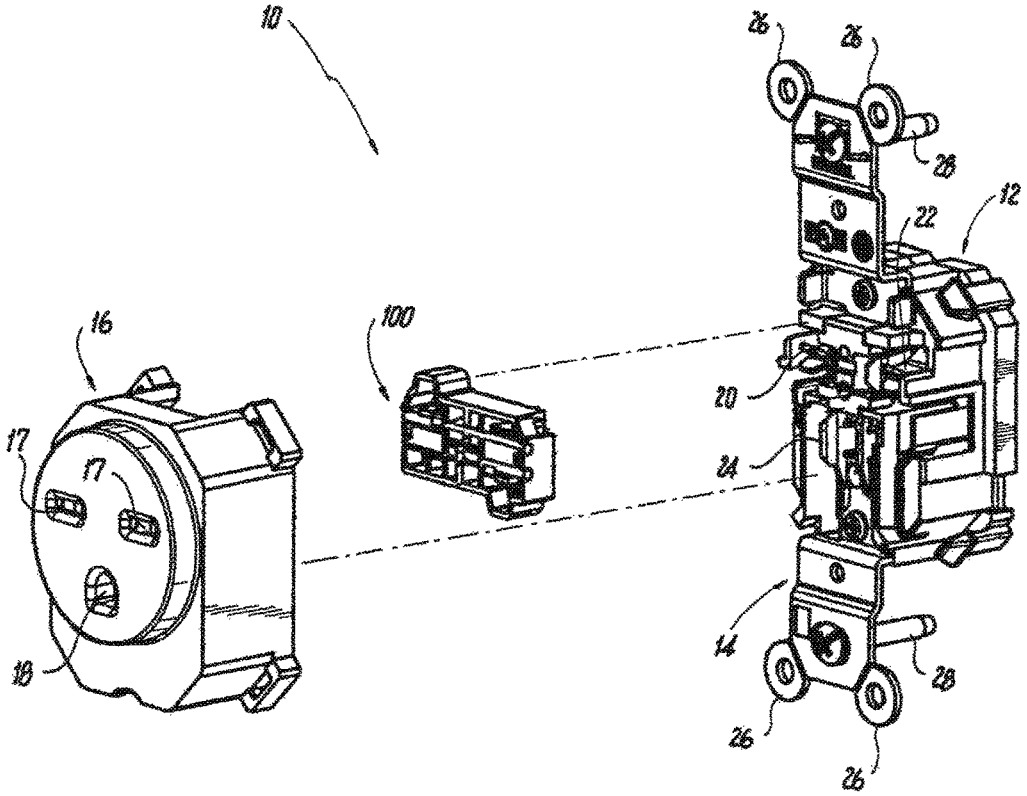
FIG. 1 is an exploded perspective view of an exemplary electrical device according to the present disclosure, illustrating a single receptacle having horizontal prong slots and incorporating an exemplary embodiment of a tamper resistant cartridge according to the present disclosure.
Figure 2:
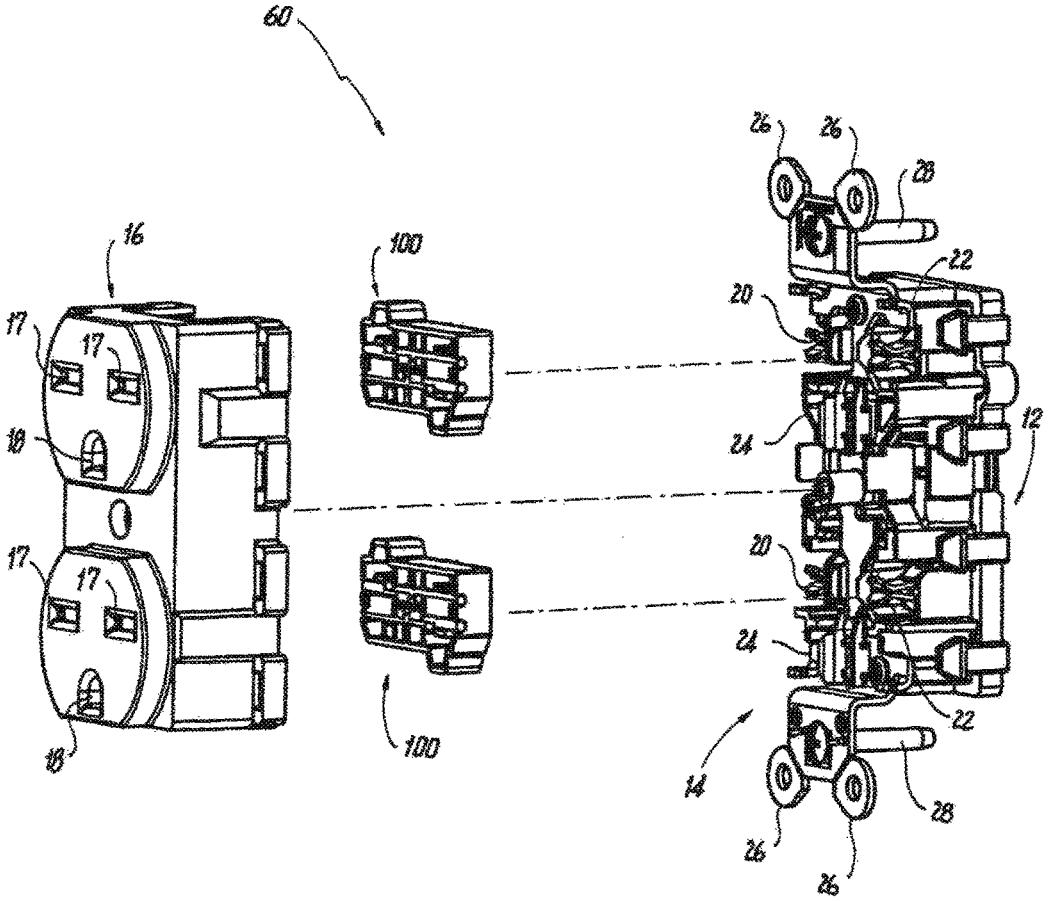
FIG. 2 is an exploded perspective view of another exemplary electrical device according to the present disclosure, illustrating a duplex receptacle having horizontal prong slots and incorporating the tamper resistant cartridge of FIG. 1.
Figure 3:
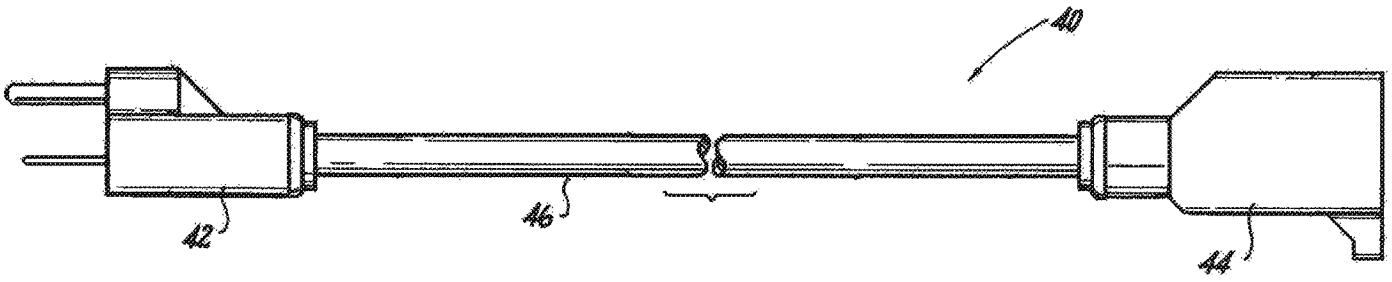
FIG. 3 is a side view of another exemplary electrical device according to the present disclosure, illustrating a power cord with an electrical receptacle at one end of the cord.
Figure 4:
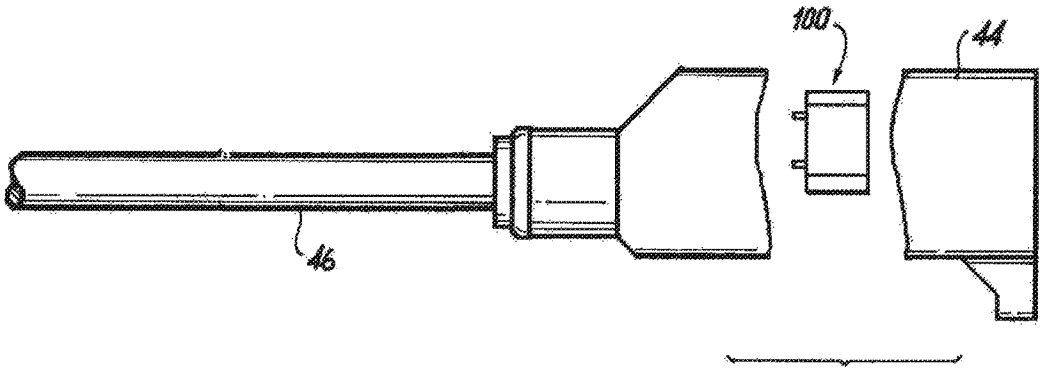
FIG. 4 is a side view of a portion of the power cord of FIG. 3, illustrating the power cord receptacle having horizontal prong slots and incorporating the tamper resistant cartridge of FIG. 1.
Figure 5:
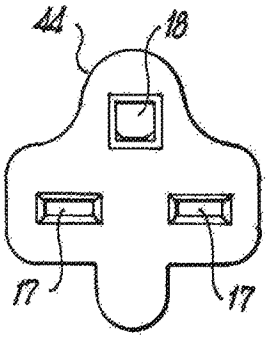
FIG. 5 is a front elevation view of the power cord receptacle of FIG. 4.

Referring to FIGS. 1-3 are configurations of electrical receptacles that include an exemplary configuration of a tamper resistant cartridge according to the present disclosure are shown. The electrical receptacle configuration shown in FIG. 1 is a single receptacle having a base with active electrical contacts to receive a single plug, a base bridge assembly having a ground contact, and a cover having horizontal openings to receive the active prongs and a ground prong opening of a plug. The electrical receptacle configuration shown in FIG. 2 is a duplex receptacle with active electrical contacts to receive two plugs, a base bridge assembly having two ground contacts, and a cover having horizontal openings to receive the active prongs of two plugs and a ground prong opening for each plug. The electrical receptacle configuration of FIG. 3 is a power cord receptacle having active electrical contacts enclosed within a base and a face, which is similar to the cover, having horizontal openings to receive the active prongs and a ground prong opening of a plug.

Referring to FIG. 1, the single receptacle 10 according to the present disclosure includes a base 12, a base bridge assembly 14, a cover 16, and a tamper resistant cartridge 100. The base 12 supports one or more wiring terminals that provide terminations for electrical conductors providing electrical power to the single receptacle 10. In the exemplary configuration disclosed, the receptacle 10 has three wiring terminals, two line phase terminals and a ground terminal. The base also includes an open central portion that supports a set of female connector members 20 and 22, for example, female binding terminals, that would be capable of engaging the prongs of a male plug inserted through the cover 16. The female connector members 20 and 22 would be electrically connected to the wiring terminals such that power from electrical distribution system conductors connected to the wiring terminals would be available at the female connector members to provide power to a plug inserted into the receptacle 10, as is known in the art.

As noted above, in the exemplary embodiment disclosed herein the electrical wiring device has three wiring terminals, two line phase terminals and a ground terminal, and the wiring terminals may be for example binding screws. For a single receptacle 10, the line phase terminals are typically positioned opposite sides of the receptacle, and are secured within channels in the base 12. The ground wiring terminal is secured within a separate channel in the base 12. The ground wiring terminal is typically part of the base bridge assembly 14. It should be noted that binding screws are exemplary of the types of wiring terminals that can be used to provide electrical connections between the electrical distribution system conductors and the receptacles. Examples of other types of wiring terminals include set screws, pressure clamps, pressure plates, push-in type connections, pigtails and quick-connect tabs.

The base bridge assembly 14, also referred to as a yoke or mounting strap, extends from one end of the base 12 through or around the base to the other end of the base as is known. The base bridge assembly 14 provides finishing ears 26 and set screws 28 to secure the receptacle 10 to an electrical device box (not shown) when installed. The base bridge assembly 14 also includes a female connector member 24, for example, a female binding terminal that would be capable of engaging the ground prong of a male plug inserted through the cover 16.

The cover 16 snap fits with the base 12 sealing the tamper resistant cartridges 100, female connector members 20 and 22, and the base bridge assembly within and/or to the base. The cover 16 includes horizontal openings or slots 17 configured to receive horizontal prongs of a plug and an opening or slot 18, e.g., a U-shaped slot, to receive a ground prong of the plug.

Referring to FIG. 2, the duplex receptacle 60 according to the present disclosure includes a base 12, a base bridge assembly 14, a cover 16 that are similar to the base, base bridge assembly and cover described above except that they are configured for two receptacles. For example, the base is larger than the base for a single receptacle and supports two sets of female connector members 20 and 22. The base bridge assembly includes two female connector members 24 for receiving two ground plugs, and the cover 16 includes two sets of horizontal slots 17 to receive horizontal prongs of two plugs, and two U-shaped ground slots 18 for receiving two ground prongs. The duplex receptacle 60 also includes two tamper resistant cartridges 100, one associated with each set of female connector members 20 and 22.

Referring to FIG. 3, the power cord 40 includes a plug 42, a receptacle 44 and a cable 46 electrically connecting the plug 42 to the receptacle 44. The receptacle 44 has two female connector members that are similar to the female connector members 20 and 22 noted above and a ground female connector member that is similar to the female connector member 24 noted above. The face of the receptacle 44 includes two horizontal slots 17 for receiving the horizontal prongs of a plug (not shown), and a ground slot 18, e.g., a U-shaped slot, for receiving a ground prong of the plug.

Referring to FIGS. 6-12, a tamper resistant cartridge according to an exemplary configuration is shown. The tamper resistant cartridge 100 may also be referred to herein as the "cartridge." The cartridge 100 is positioned within the receptacle, e.g., in the cover or adjacent the face of the receptacle (collectively the "cover"), between the horizontal slots 17 in the cover 16 and the female connector members 20 and 22 within the receptacle. The cartridge 100 blocks objects, such as knives, paper clips, screw drivers, etc. from being inserted into the horizontal slots 17 while permitting prongs of a plug to pass through the cartridge 100 when properly inserted into the slots 17 of the receptacle 10 or 60.

Figure 6:
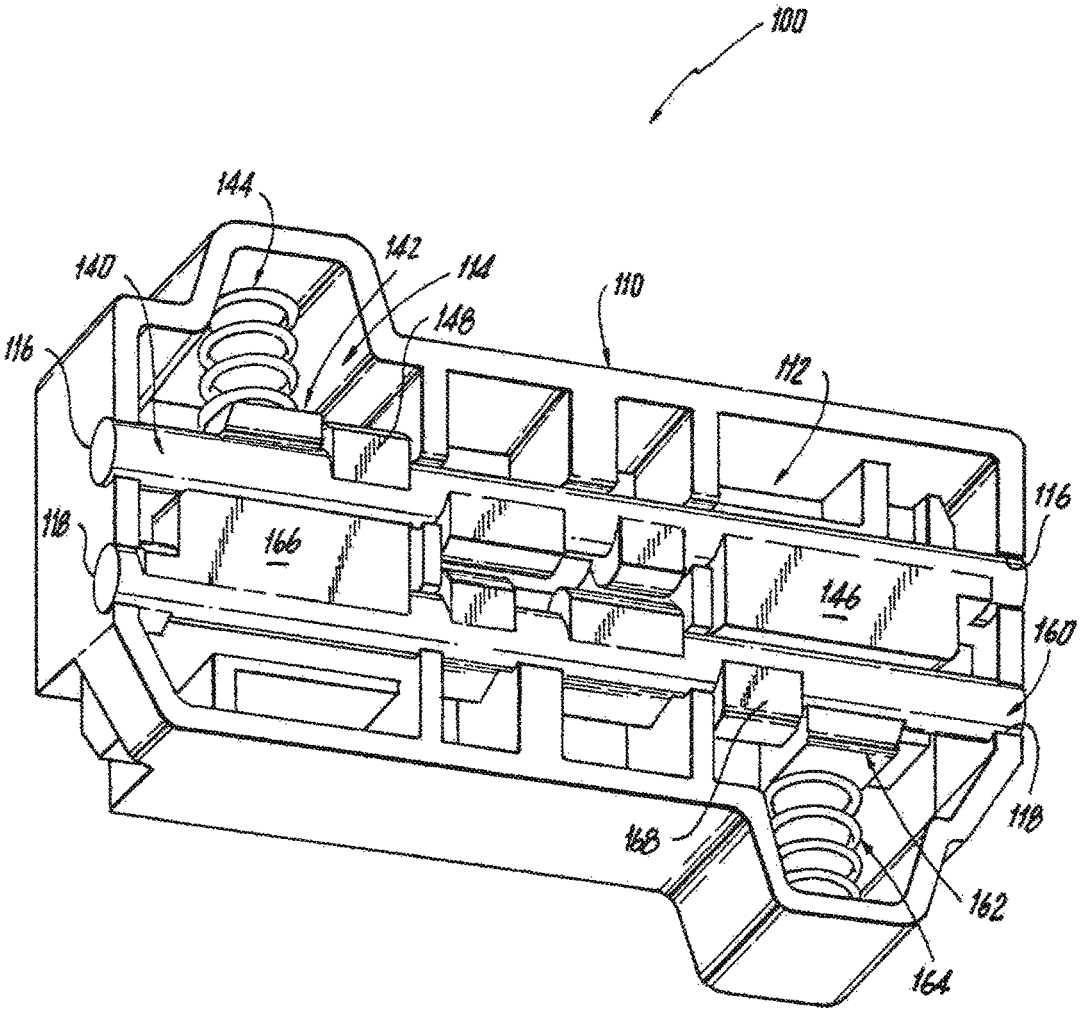
FIG. 6 is a perspective view of an exemplary embodiment of the tamper resistant cartridge of FIG. 1.
Figure 7:
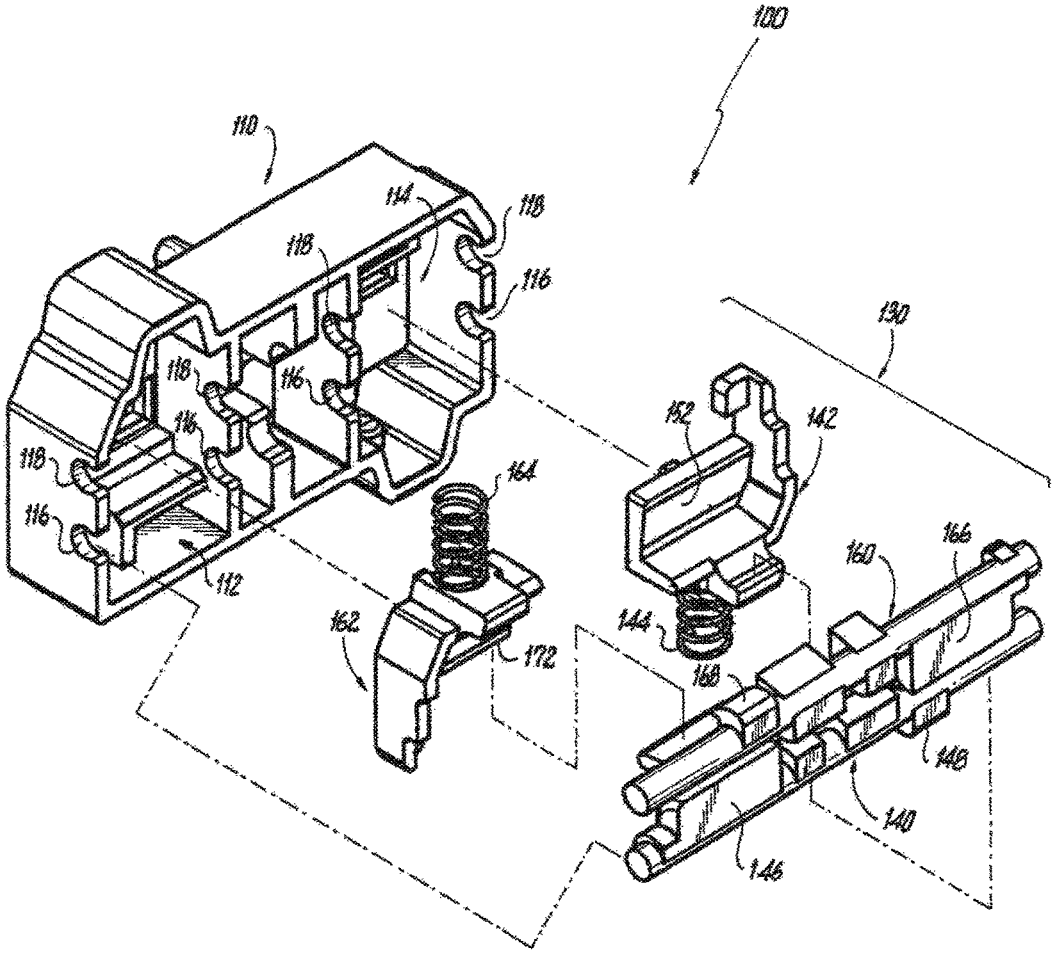
FIG. 7 is an exploded perspective view of the tamper resistant cartridge of FIG. 6, illustrating a tamper resistant assembly and a housing.

As seen in FIGS. 6 and 7, the cartridge 100 includes a housing 110 and a tamper resistant assembly 130. The housing 110 includes a number of chambers or cavities to support components of the tamper resistant assembly 130 as will be described. For example, the housing includes a first shutter chamber 112 and a second shutter chamber 114. The housing 110 also includes a plurality of notches 116 and 118 where the shutter arms of the tamper resistant assembly rest. The housing 110 also includes openings 120, e.g., horizontal slots seen in FIG. 10, that permit a horizontal prong of a plug to pass through the housing 110.

Figure 8:
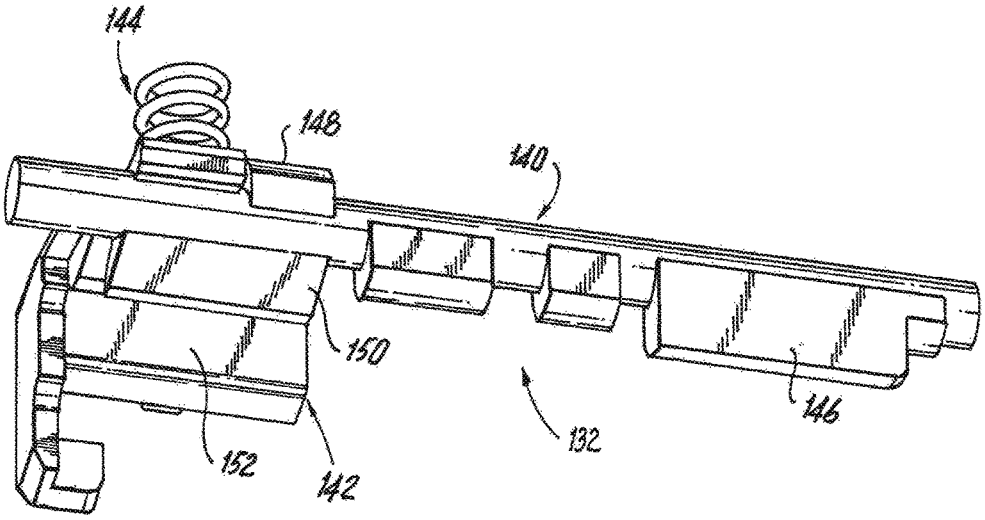
FIG. 8 is a perspective view of a first shutter arm and slider of the tamper resistant assembly of FIG. 7.
Figure 9:
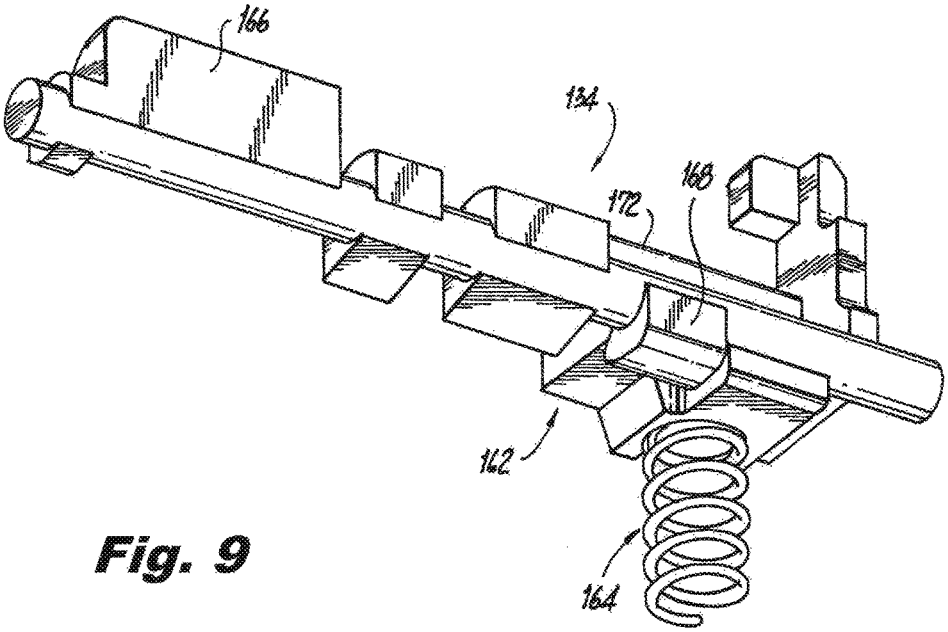
FIG. 9 is a perspective view of a second shutter arm and slider of the tamper resistant assembly of FIG. 7.
Figure 10:
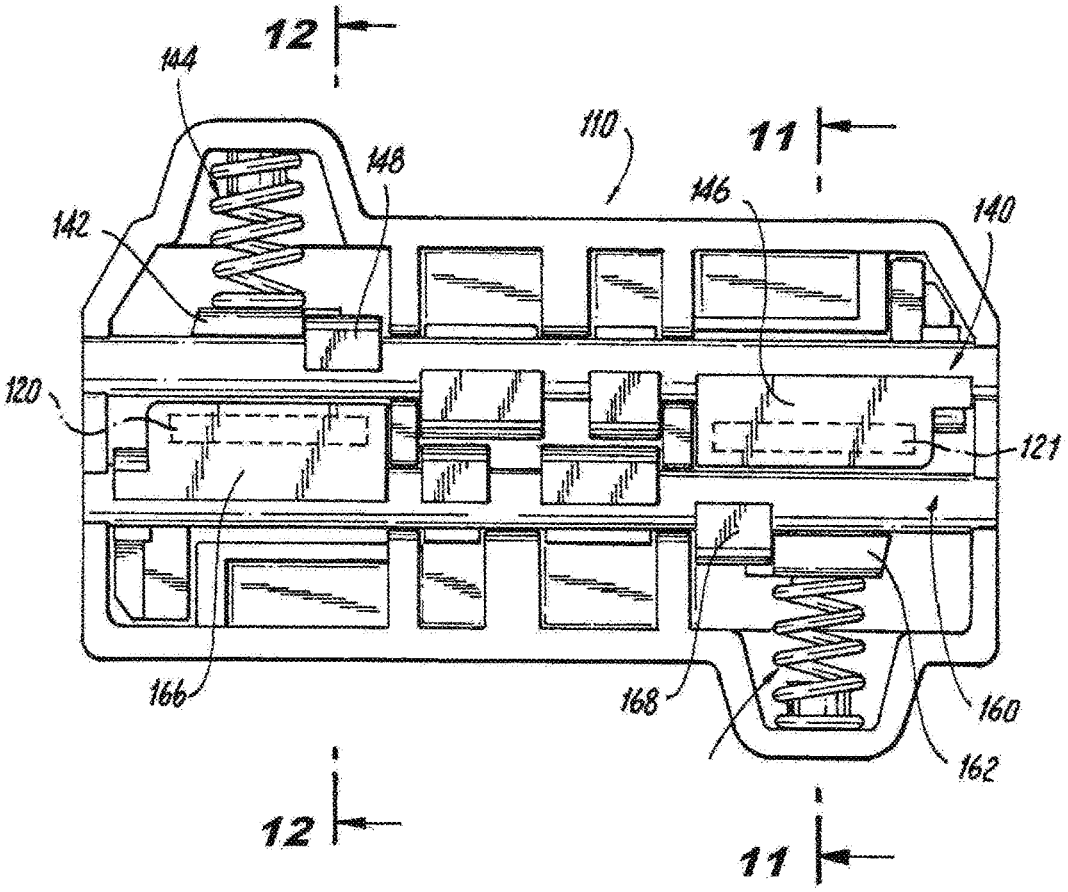
FIG. 10 is a top plan view of the tamper resistant cartridge of FIG. 6.
Figure 11:
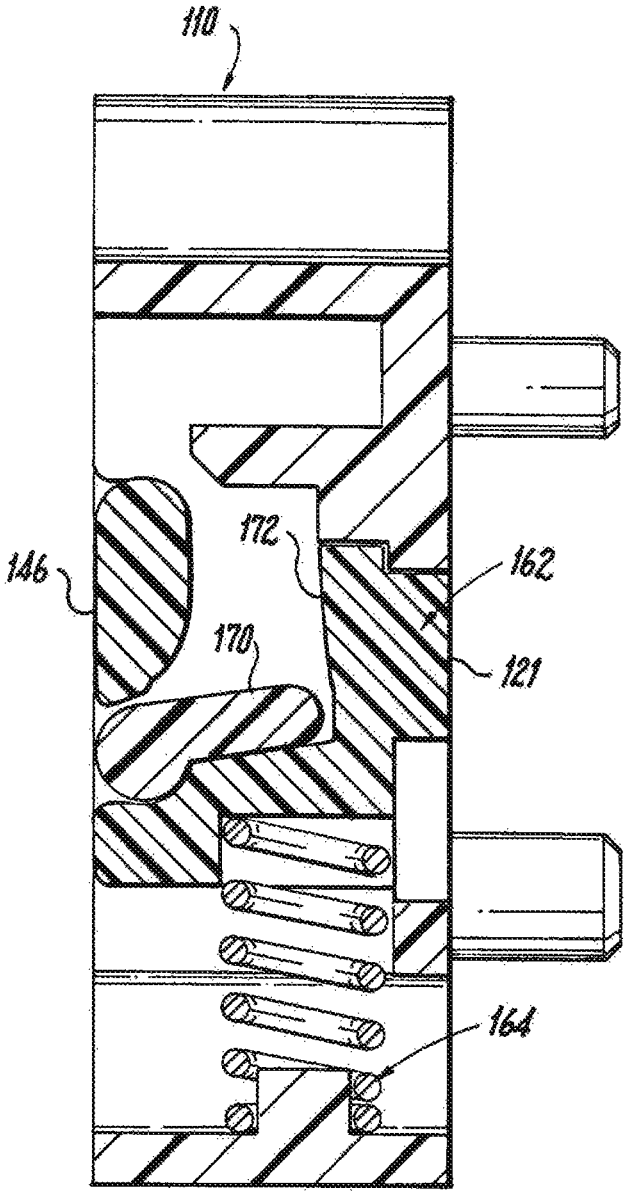
FIG. 11 is a cross-sectional view of the tamper resistant cartridge of FIG. 10 taken along line 11-11.
Figure 12:
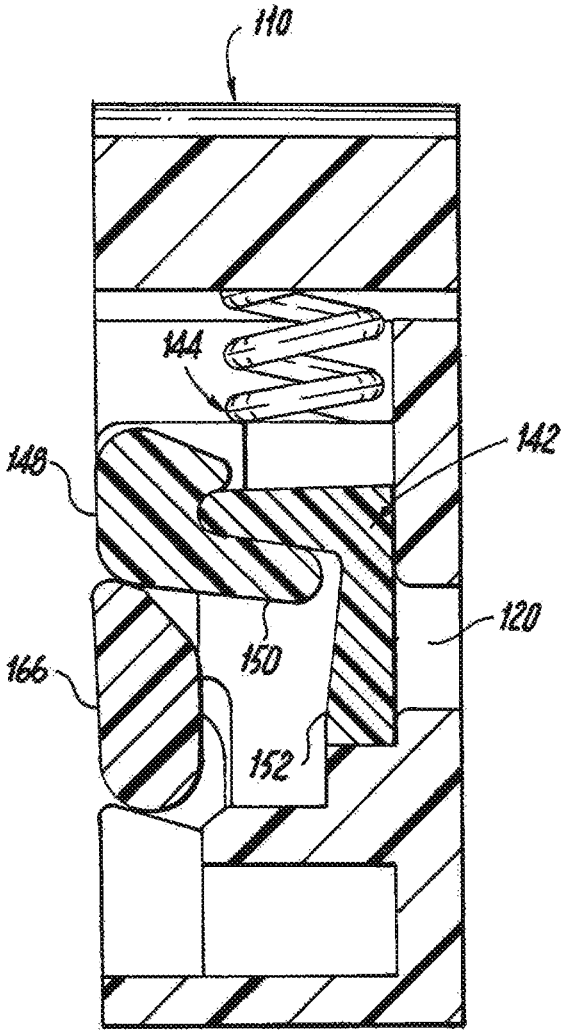
FIG. 12 is a cross-sectional view of the tamper resistant cartridge of FIG. 10 taken along line 12-12.
Figure 13:
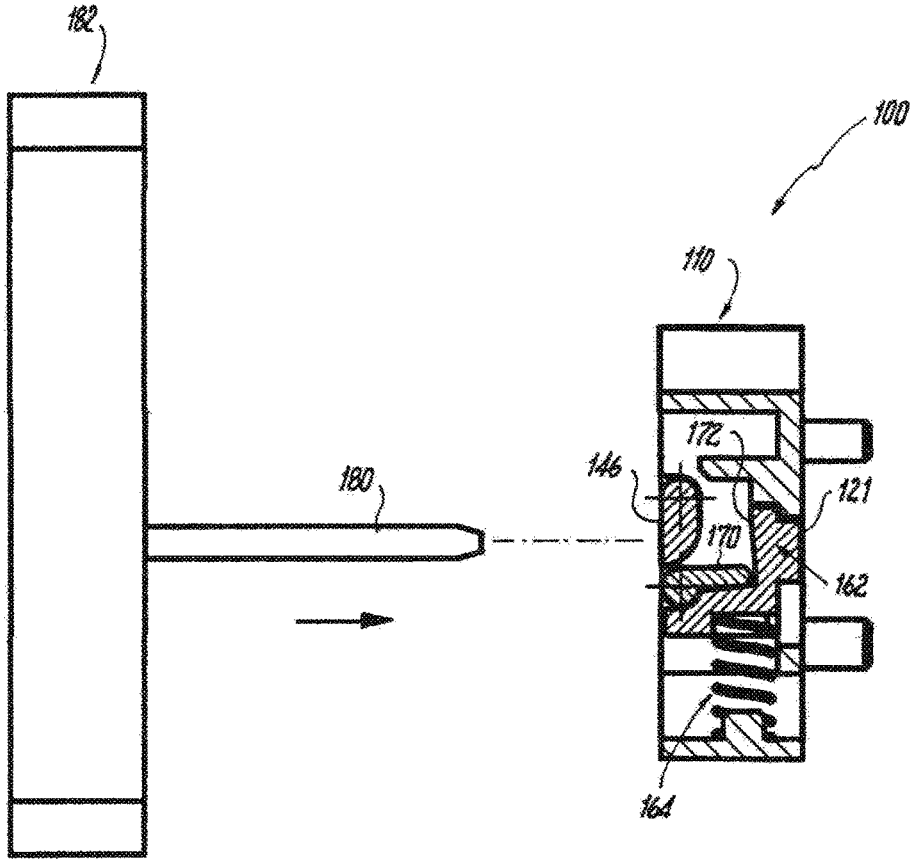
FIG. 13 is the cross-sectional view of the tamper resistant cartridge of FIG. 11 and a prong of a plug positioned for entry into the tamper resistant cartridge.
Figure 14:
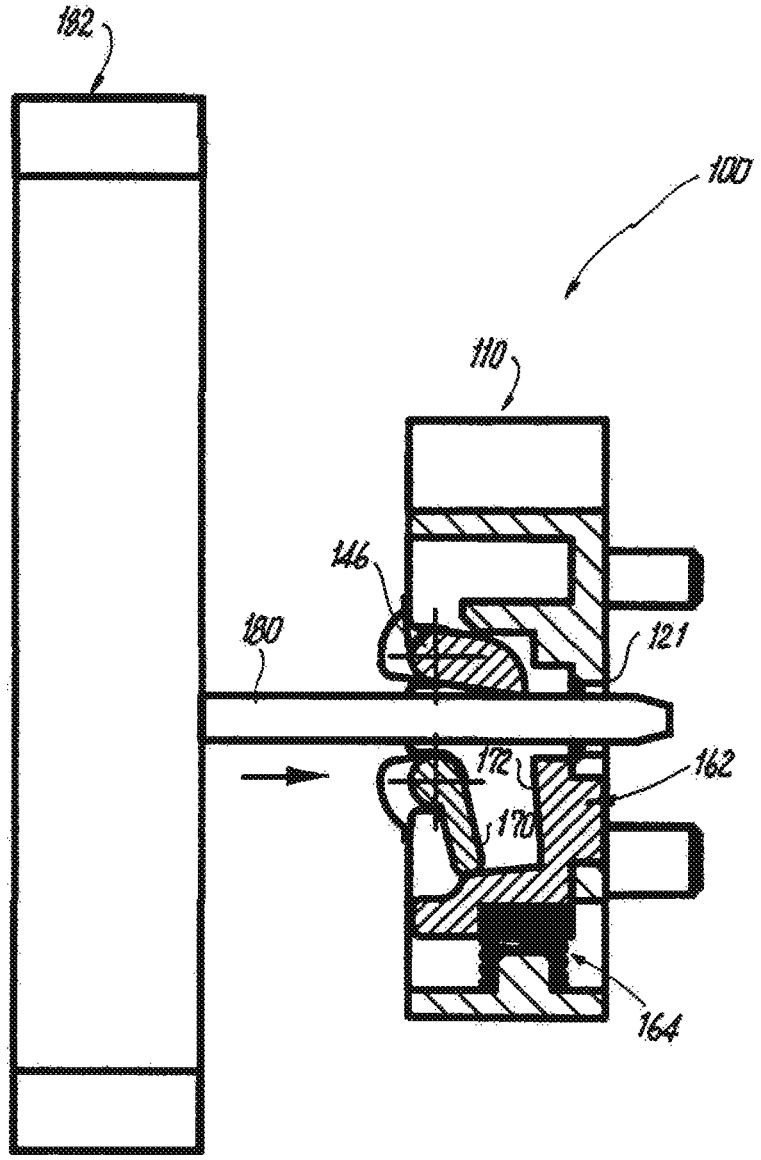
FIG. 14 is the cross-sectional view of the tamper resistant cartridge and plug of FIG. 13 illustrating the prong of the plug passing through the tamper resistant cartridge.

The tamper resistant assembly 130 includes a first shutter assembly 132, seen in FIG. 8, and a second shutter assembly 134, seen in FIG. 9. The first shutter assembly 132 has a first shutter arm 140, a first slider 142 and a first spring 144. The first shutter arm 140 rests within notches 116 in the housing 110 so that the first shutter arm 140 can pivot or rotate within the notches 116. Attached to or integrally formed into the shutter arm 140 is a shutter 146, a slider lock 148 and a cam 150. The shutter 146 is positioned on the shutter arm 140 so that it would be adjacent a horizontal slot 17 in the cover 16 of the receptacle 10 or 60. The shutter 146 is provided to activate the tamper resistant assembly to unblock access to a female connector member 20 or 22 within the receptacle base 12 and permits a prong of a plug to pass through the cartridge 100 to mate with the corresponding female connector member. The slider lock 148 is positioned on the shutter arm 140 so that it is adjacent the first slider 142 in one of the chambers in the housing 110. The slider lock 148 prevents movement of the first slider 142 until released by rotation of the first shutter arm 140 as will be described below. The slider 142 has a floor 152 that is provided to normally block access to a female connector member 20 or 22 within the receptacle base 12 and to selectively permit a prong of a plug to pass through the opening 120 in the cartridge housing 110 to mate with the female connector member. The spring 144 is a compression spring that normally biases the slider 142 in a direction toward the center of the housing 110 so that the floor 152 of the slider 142 blocks the opening 120 in the housing 110.

The second shutter assembly 134 includes a second shutter arm 160, a second slider 162 and a second spring 164. The second shutter arm 160 rests within notches 118 in the housing 110 so that the second shutter arm 160 can pivot or rotate within the notches 118. Attached to or integrally formed into the second shutter arm 160 is a shutter 166, a slider lock 168 and a cam 170, seen in FIG. 11. The shutter 166 is positioned on the shutter arm 160 so that it would be adjacent a horizontal slot 17 in the cover 16 of the receptacle 10 or 60. The second shutter 166 is also provided to activate the tamper resistant assembly to unblock access to a female connector member 20 or 22 within the receptacle base 12 and to selectively permit a prong of a plug to pass through the cartridge 100 to mate with the female connector member. The slider lock 168 is positioned on the shutter arm 160 so that it is adjacent the second slider 162 in one of the chambers in the housing 110. The slider lock 168 prevents movement of the second slider 162 until released by rotation of the second shutter arm 160 as will be described below. The slider 162 has a floor 172 that is provided to block access to a female connector member 20 or 22 within the receptacle base 12 and to selectively permit a prong of a plug to pass through the opening 120 in the cartridge housing 110 to mate with the female connector member. The spring 164 is a compression spring that normally biases the slider 162 in a direction toward the center of the housing 110 so that the floor 172 of the slider 162 blocks the opening 120 in the housing 110.

In operation, with specific reference to FIGS. 6, 10-14, when each horizontal prong 180 of a plug 182 is inserted into a horizontal slot 17 in cover 16 of receptacle 10 or 60, each prong 180 applies a force to each respective shutter 146 or 166. The force applied to the first shutter 146 causes the first shutter 146 to rotate in a downward direction, i.e., to rotate into the housing, so that the first shutter arm 140 rotates. Similarly, the force applied to the second shutter 166 causes the second shutter 166 to rotate in a downward direction, i.e., to rotate into the housing, so that the second shutter arm 160 rotates. Rotation of the shutter arms 140 and 160 causes the respective slider locks 148 and 168 to rotate in an upward direction, i.e., away from the housing. Upward rotation of the slider lock 148 releases the first slider 142 freeing it to move, e.g., to slide, within its chamber in the housing 110. Upward rotation of the slider lock 168 releases the second slider 160 freeing it to move, e.g., to slide, within its chamber in the housing 110. With each slider 142 and 162 free to slide within their respective chamber within the housing 110, further rotation of the shutter arms 140 and 160 causes the respective cams 150 and 170 to move the sliders. More specifically, further rotation of the shutter arm 140 causes the cam 150 to push the first slider 142 in a direction away from the center of the housing 110 compressing spring 144 and moving the floor 152 of the first slider 142 in a direction away from the horizontal opening 120 in the housing 110 so that the horizontal prong 180 of the plug 182 can pass through the tamper resistant cartridge 100, similar to the motion shown in FIG. 14. Further, rotation of the shutter arm 160 causes the cam 170 to push the second slider 162 in a direction away from the center of the housing 110 compressing spring 164 and moving the floor 172 of the second slider 162 in a direction away from horizontal opening 121 in the housing 110 so that horizontal prong 180 of the plug 182 can pass through the tamper resistant cartridge 100. It is noted that having movement of one shutter 146 or 166 causing the movement of a floor 152 or 172 blocking a horizontal opening on an opposite side from the shutter moved ensures that both horizontal prongs of a plug are to be inserted at the same time in order to activate the tamper resistant assembly and unblock the openings 120 and 121 in the housing 110. If only one prong or an object were to be inserted into a slot 17 the tamper resistant assembly would not activate thus blocking entry of the prong or object.

When the plug 182 is removed from the receptacle 10 or 60, the springs 144 and 164 push the respective sliders 142 or 162 in a direction toward the center of the housing 110 so that the floors 152 and 172 block access to the housing openings 120 in the housing 110 and thus blocking access to the female connector members 20 and 22 within the base 12. The movement of the sliders 142 and 162 also causes the cams 150 and 170 to rotate in the opposite direction. The reverse rotation of the cams causes the shutter arms 140 and 160 to rotate causing the slider locks 148 and 168 to lock the sliders 142 and 162 to prevent movement of the sliders. Further reverse rotation of the shutter arms 140 and 160 causes the shutters 146 and 166 to again block the horizontal openings in the cover of the receptacle, thus resetting the tamper resistant assembly to its normal position.

Figure 15:
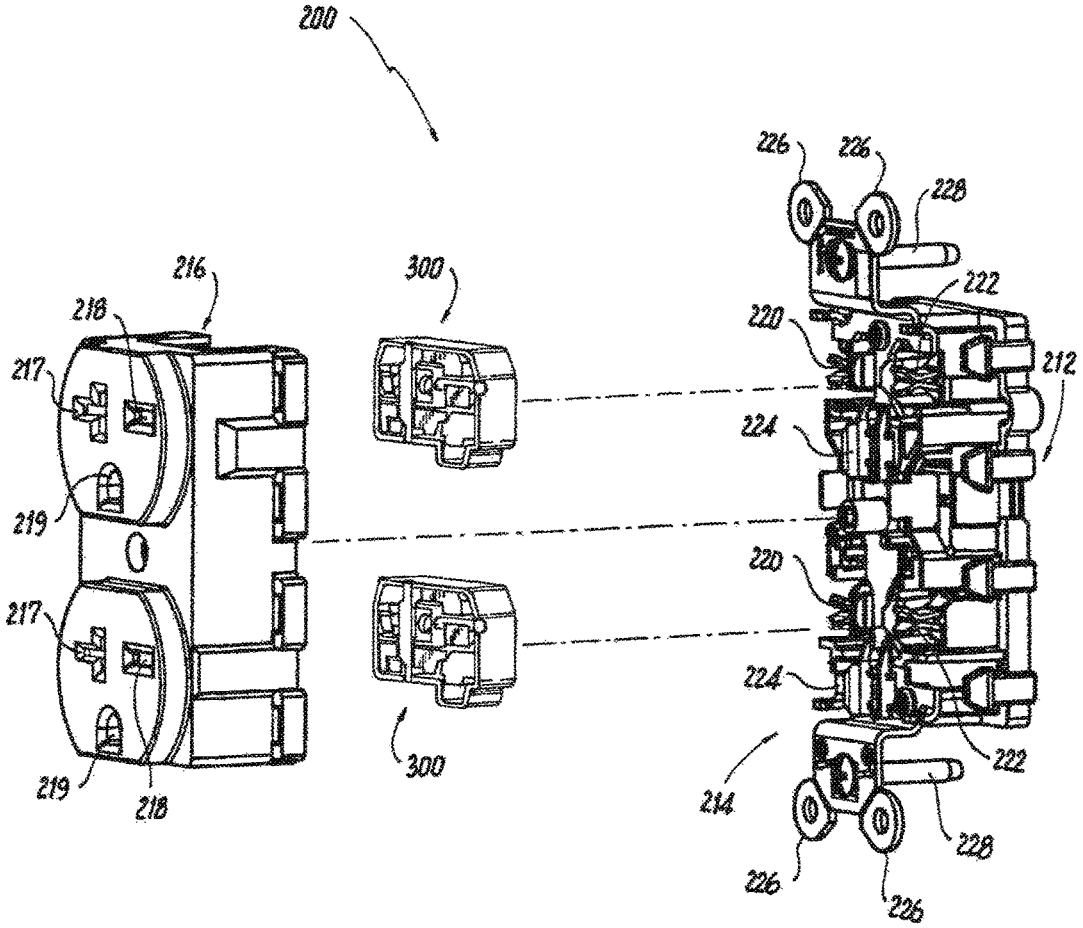
FIG. 15 is an exploded perspective view of another exemplary electrical device according to the present disclosure, illustrating a duplex receptacle having a T-shaped prong slot and a horizontal prong slot and incorporating another exemplary embodiment of the tamper resistant cartridge according to the present disclosure.

Referring to FIG. 15, a duplex receptacle 200 according to another exemplary embodiment is shown. In this exemplary embodiment, the duplex receptacle 200 includes a base 212, a base bridge assembly 214, a cover 216, and two tamper resistant cartridges 300. The base 212 supports one or more wiring terminals that provide terminations for electrical conductors providing electrical power to the duplex receptacle 200. In the exemplary embodiment disclosed, the receptacle 200 has five wiring terminals, four line phase terminals and a ground terminal. The base 212 also includes an open central portion that supports two sets of female connector members 220 and 222, for example, female binding terminals, that would be capable of engaging the prongs of a male plug inserted through the cover 216 and into the female connector members. The female connector members would be electrically connected to the wiring terminals such that power from electrical distribution system conductors connected to the wiring terminals would be available at the female connector members to provide power to a plug inserted into the receptacle 200, as is known in the art.

As noted above, in the exemplary embodiment disclosed herein the electrical wiring device has five wiring terminals, four line phase terminals and a ground terminal, and the wiring terminals may be for example binding screws. For duplex receptacle 200, one set of line phase terminals may be positioned on one side of the receptacle and another set of line phase terminals may be positioned on an opposite side of the receptacle. The terminals are secured within channels in the base 212. The ground wiring terminal is secured within a separate channel in the base 212. The ground wiring terminal is typically part of base bridge assembly 214. It should be noted that binding screws are exemplary of the types of wiring terminals that can be used to provide electrical connections between the electrical distribution system conductors and the receptacles. Examples of other types of wiring terminals include set screws, pressure clamps, pressure plates, push-in type connections, pigtails and quick-connect tabs.

The base bridge assembly 214, also referred to as a yoke or mounting strap, extends within or around the base 212 from one end of the base through or around the base to the other end of the base as is known. The base bridge assembly 214 provides finishing ears 226 and set screws 228 to secure the receptacle 200 to an electrical device box (not shown) when installed. The base bridge assembly 214 also includes two female connector members 224, for example, female binding terminals that would be capable of engaging the ground prong of a male plug inserted through the cover 216. The cover 216 snap fits with the base 212, and includes openings or slots 217, 218 and 219 configured to receive prongs of a plug that mate with the female connector members 220, 222 or 224. In the configuration of FIG. 15, the slots 217 are T-shaped slots associated with the female connector members 220, and slots 218 are horizontal slots associated with female connector members 222. Slots 219 are U-shaped slots configured to receive a ground prong of a plug. In this exemplary configuration, the T-shape slots 217 are included in receptacles rated for certain currents, here up to 20 amps, so that the receptacle 200 can receive plugs rated for 15 amps (having 2 horizontal slots) and plugs rated for 20 amps (having one vertical slot and one horizontal slot).

Figure 16:
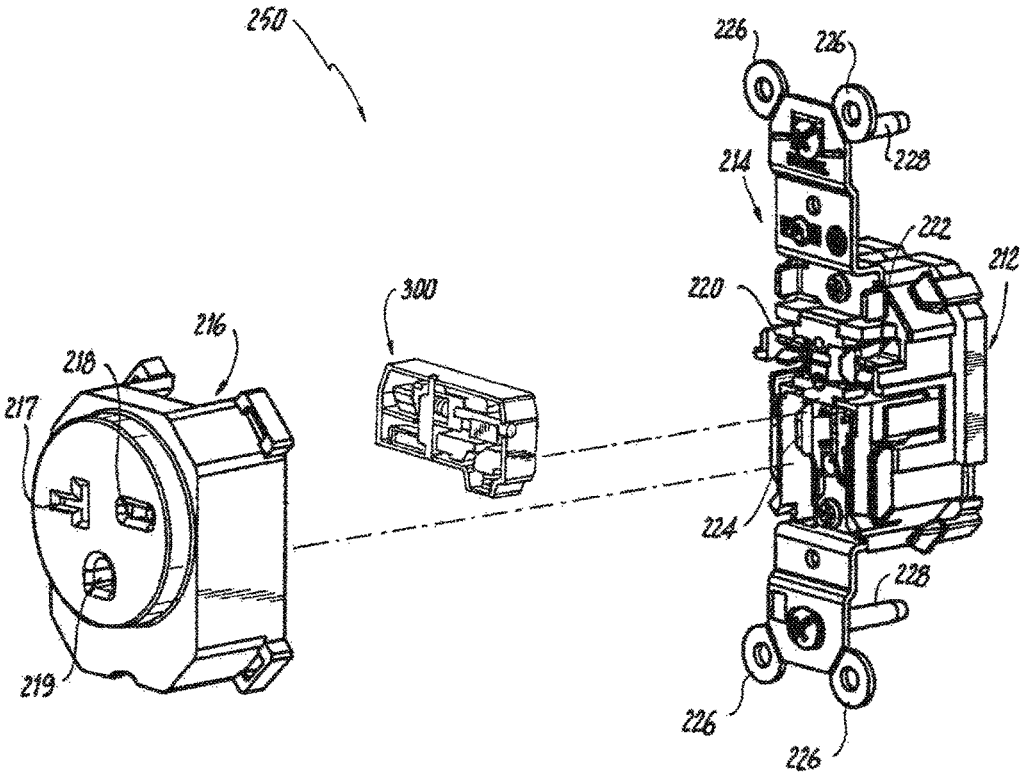
FIG. 16 is an exploded perspective view of another exemplary electrical device according to the present disclosure, illustrating a single receptacle having a T-shaped prong slot and a horizontal prong slot and incorporating the tamper resistant cartridge of FIG. 15.

Referring to FIG. 16, a single receptacle 250 according to the present disclosure includes a base 212, a base bridge assembly 214, and a cover 216 that are similar to the base, base bridge assembly and cover described above except that they are configured for a single receptacle. For example, the base is smaller than the base for a duplex receptacle and supports a single set of female connector members 220 and 222. The base bridge assembly includes one female connector member 224 for receiving one ground plug, and the cover 216 includes a single T-shaped slot 217, a single horizontal slot 218 and a single U-shaped ground slot 219. The single receptacle 250 also includes a single tamper resistant cartridge 300 associated with the female connector members 220 and 222.

Figure 17:
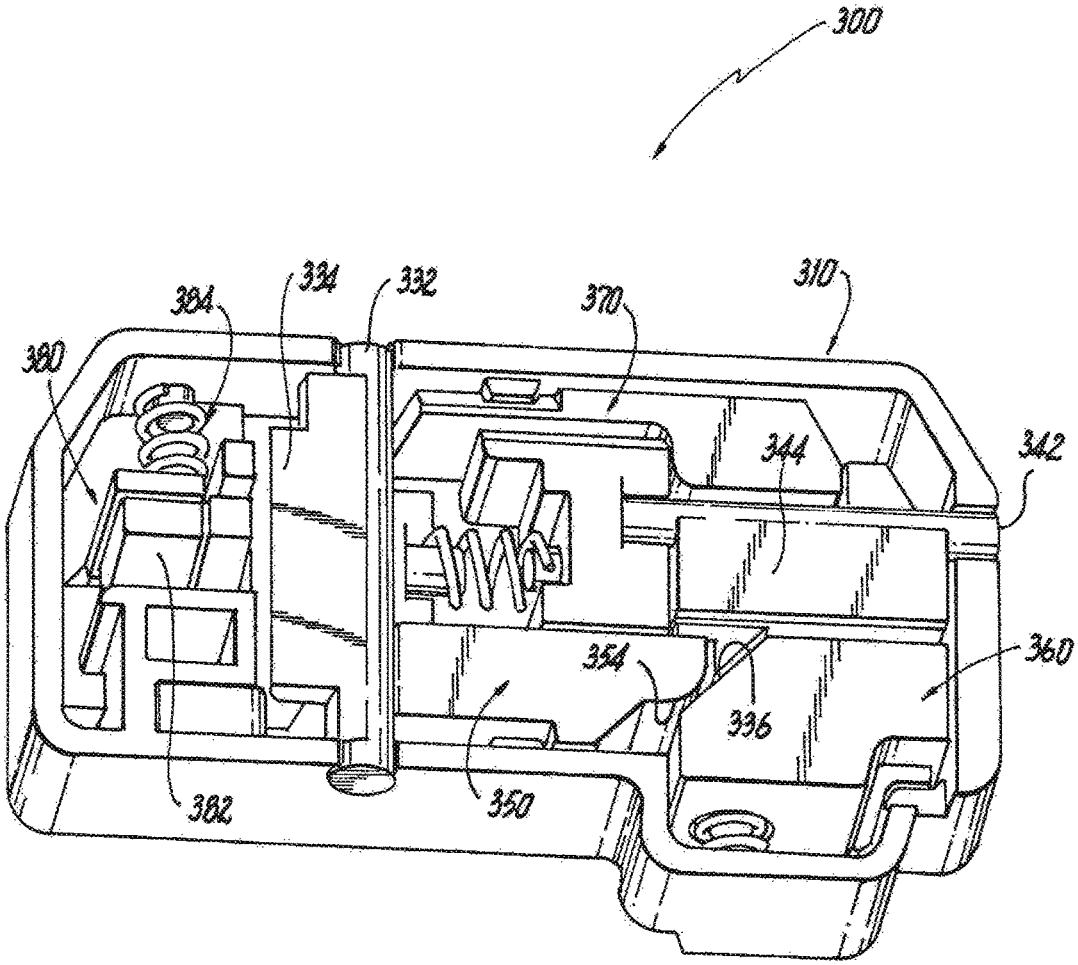
FIG. 17 is a perspective view of another exemplary embodiment of the tamper resistant cartridge of FIG. 15.
Figure 18:
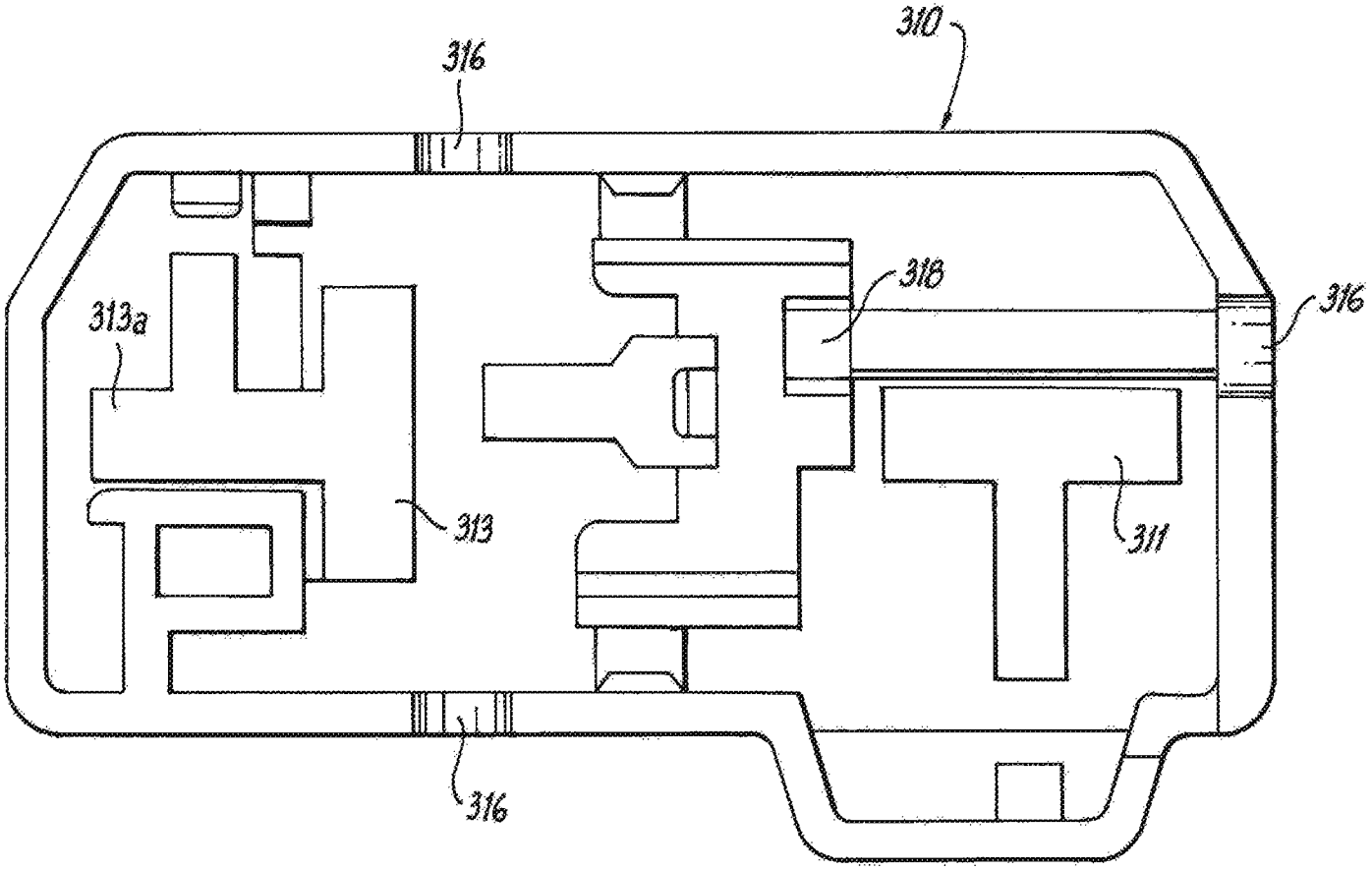
FIG. 18 is a plan view of the housing of the tamper resistant cartridge of FIG. 17.
Figure 19:
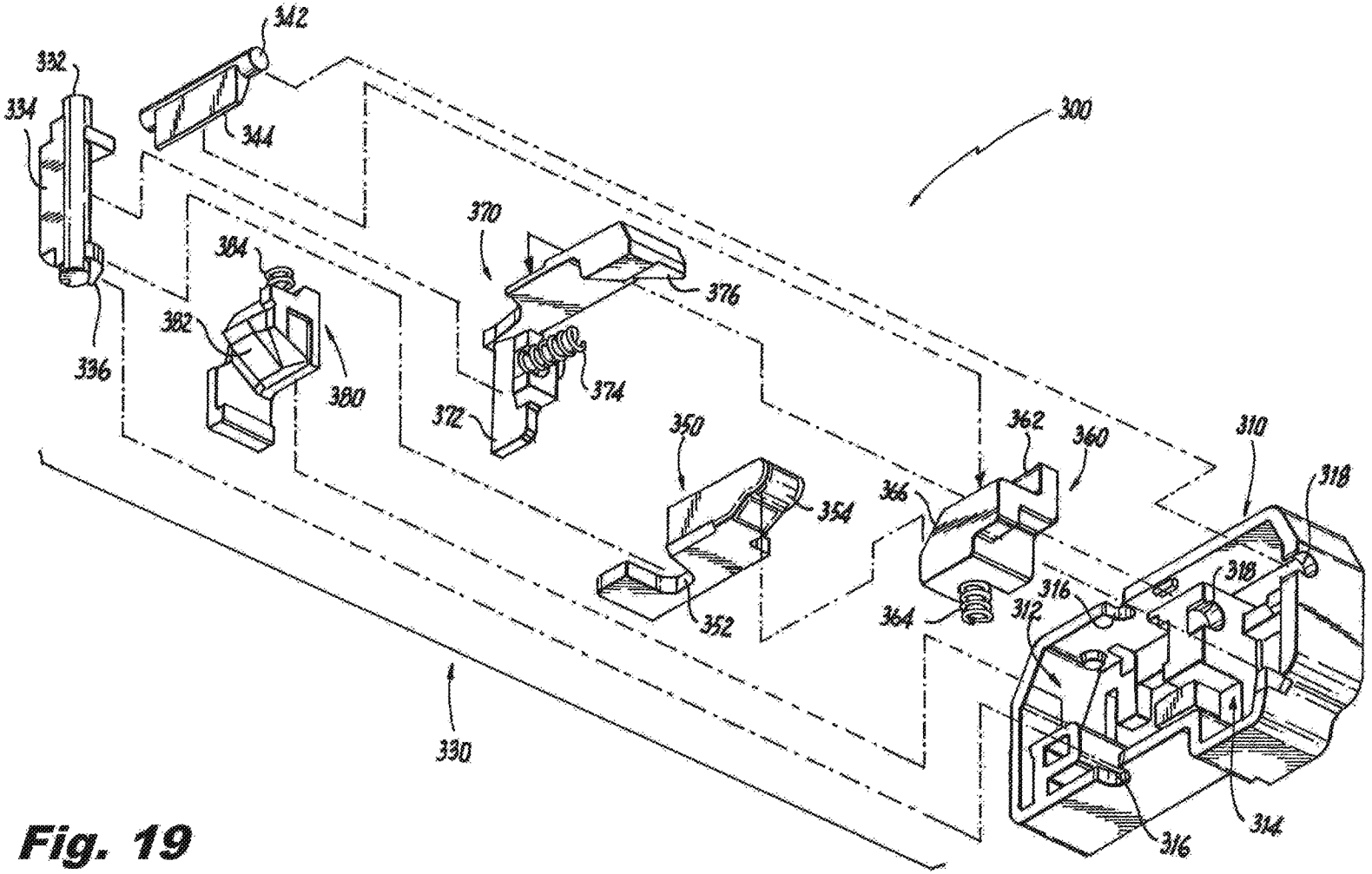
FIG. 19 is an exploded perspective view of the tamper resistant cartridge of FIG. 17, illustrating a tamper resistant assembly and the housing.

As seen in FIGS. 17-19, the cartridge 300 includes a housing 310 and a tamper resistant assembly 330. The housing 310 includes a number of chambers or cavities to support components of the tamper resistant assembly 330 as will be described. For example, the housing includes a first shutter chamber 312 and a second shutter chamber 314, seen in FIG. 19. The housing 310 also includes a plurality of notches 316 and 318 where the shutter arms of the tamper resistant assembly rest. The housing 310 also includes openings or slots, e.g., a T-shaped opening or a horizontal opening, that permit a prong of a plug to pass through the housing 310.

The tamper resistant assembly 330 includes a first shutter arm 332, a second shutter arm 342, a first slider 350, a second slider 360, a third slider 370 and a fourth slider 380. The shutter arms and sliders are interconnected such that access to the female connector members 220 and 220 of the receptacle are normally blocked by the sliders, and access to the female connector members 220 and 222 within the base 212 is selectively permitted upon proper activation of the tamper resistant assembly 330 via the first and second shutter arms 332 and 342.

Figure 20:
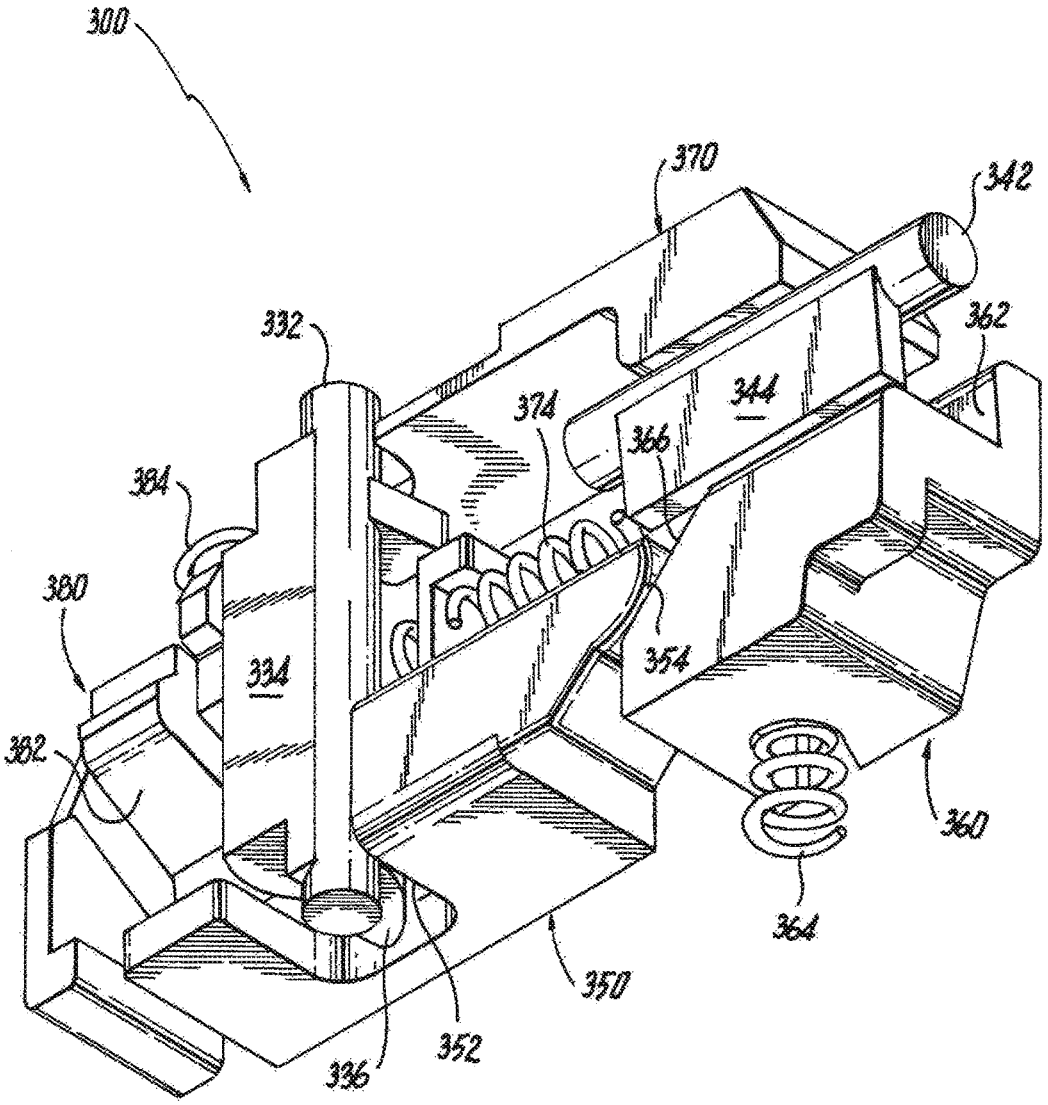
FIG. 20 is a top perspective view of the tamper resistant cartridge of FIG. 17 without a housing and illustrating the tamper resistant assembly in a blocking or protection position.

The first shutter arm 332 has a shutter 334 attached to or integrally formed into the shutter arm 332 and a first cam 336, seen in FIG. 20, attached to or integrally formed into the shutter arm 332. The first shutter arm 332 rests within notches 316 in the housing 310 so that the first shutter arm can pivot or rotate within the notches 316. The shutter 334 is positioned on the shutter arm 332 so that it would be adjacent the T-shaped slot 217 in the cover 216 of the receptacle 200 or 250. The shutter 334 is provided to activate the tamper resistant assembly to unblock access to a female connector member 220 or 222 within the receptacle base 212, and to selectively permit a prong of a plug to pass through the cartridge 300 via an opening in the housing to mate with the female connector member. The second shutter arm 342 has a shutter 344 attached to or integrally formed into the shutter arm 342. The second shutter arm 342 rests within notches 318 in the housing 310 so that the second shutter arm can pivot or rotate within the notches 318. The shutter 344 is positioned on the shutter arm 342 so that it would be adjacent the horizontal slot 218 in the cover 216 of the receptacle 200 or 250. The shutter 344 is also provided to activate the tamper resistant assembly to unblock access to a female connector member 220 or 222 within the receptacle base 212, and to selectively permit a prong of a plug to pass through the cartridge 300 to mate with the female connector member. In the configuration of FIGS. 17 and 19, the first shutter 334 is orientated within the housing 310 such that it is substantially perpendicular to the second shutter 344, as shown in FIG. 17. This arrangement of the shutters 334 and 344 permits the tamper resistant cartridge 300 to work with two horizontal prongs typically associated with a 15 amp, 250 volt rated plug or with a vertical prong and a horizontal prong typically associated with a 20 amp, 250 volt rated plug.

Figure 21:
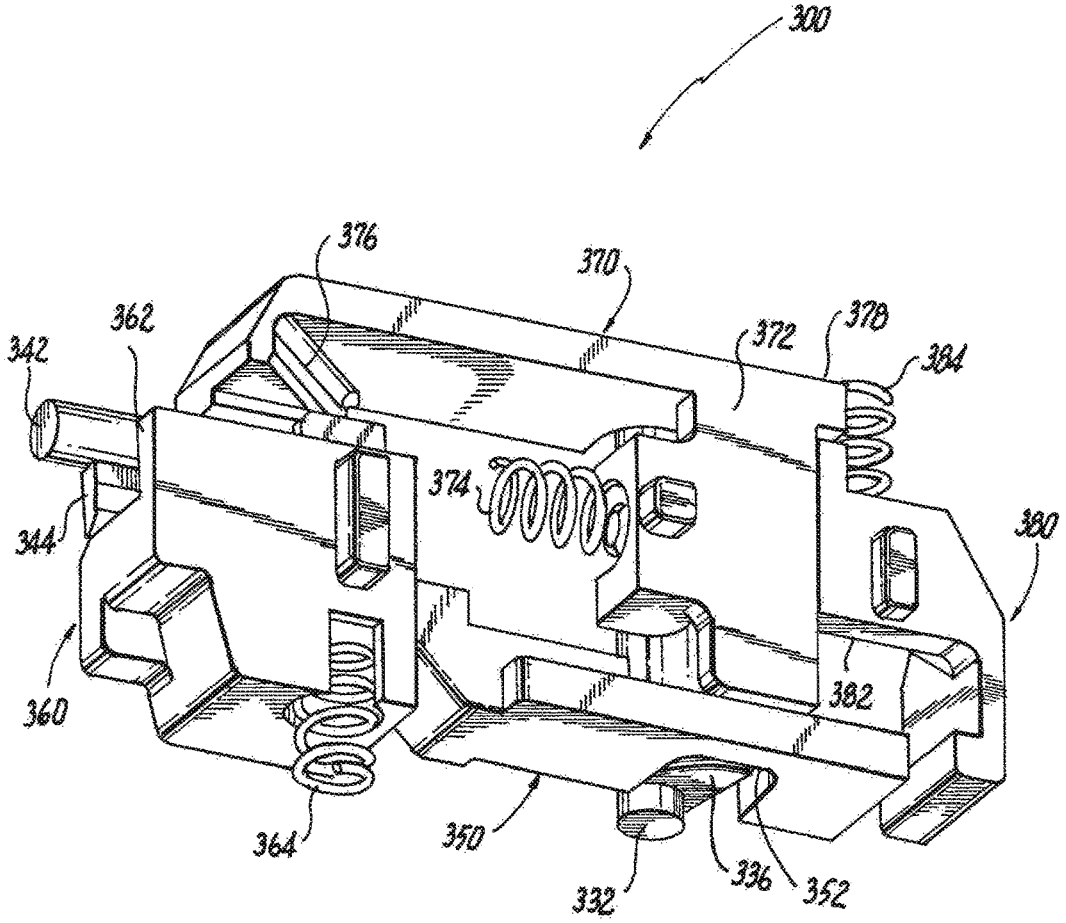
FIG. 21 is a bottom perspective view of the tamper resistant cartridge of FIG. 20.
Figure 22:
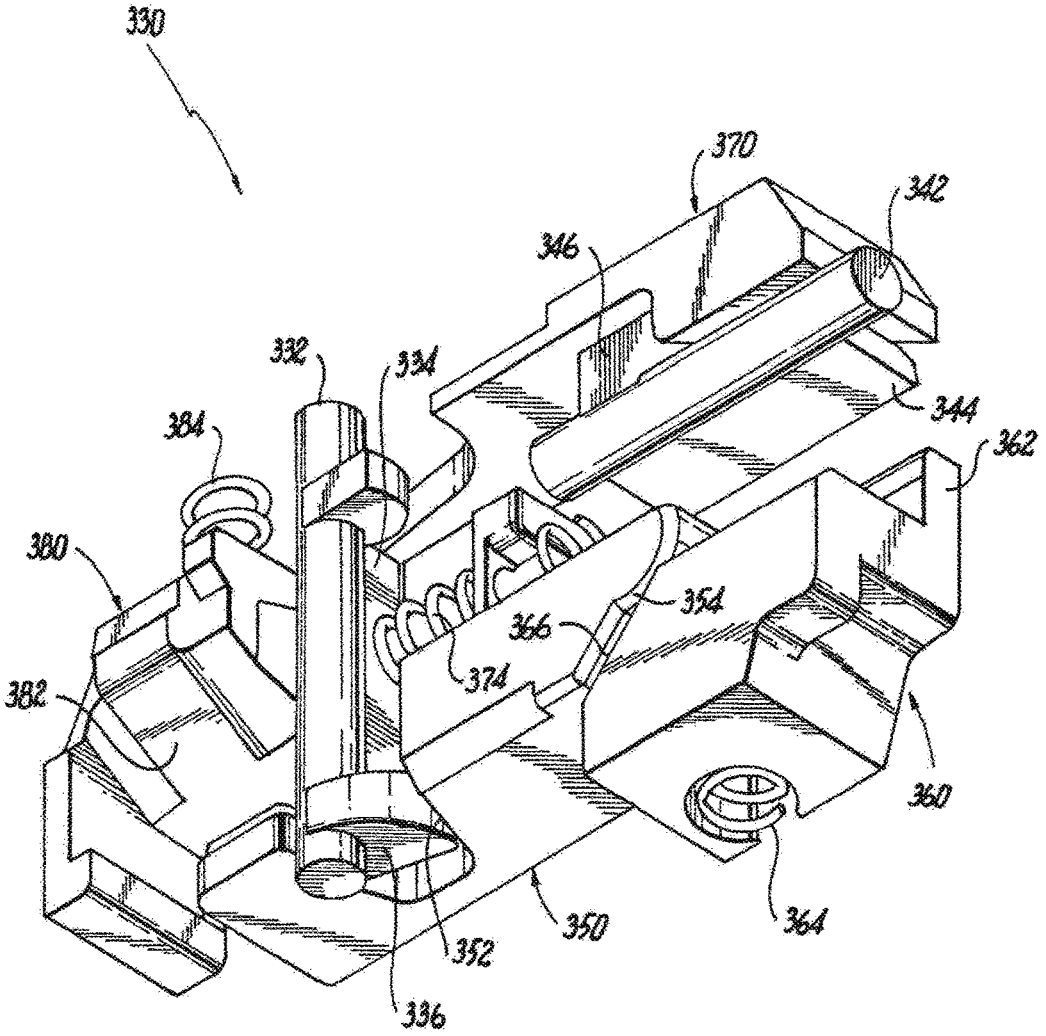
FIG. 22 is a top perspective view of the tamper resistant cartridge of FIG. 17 without a housing and illustrating the tamper resistant assembly in a pass-through position.
Figure 23:
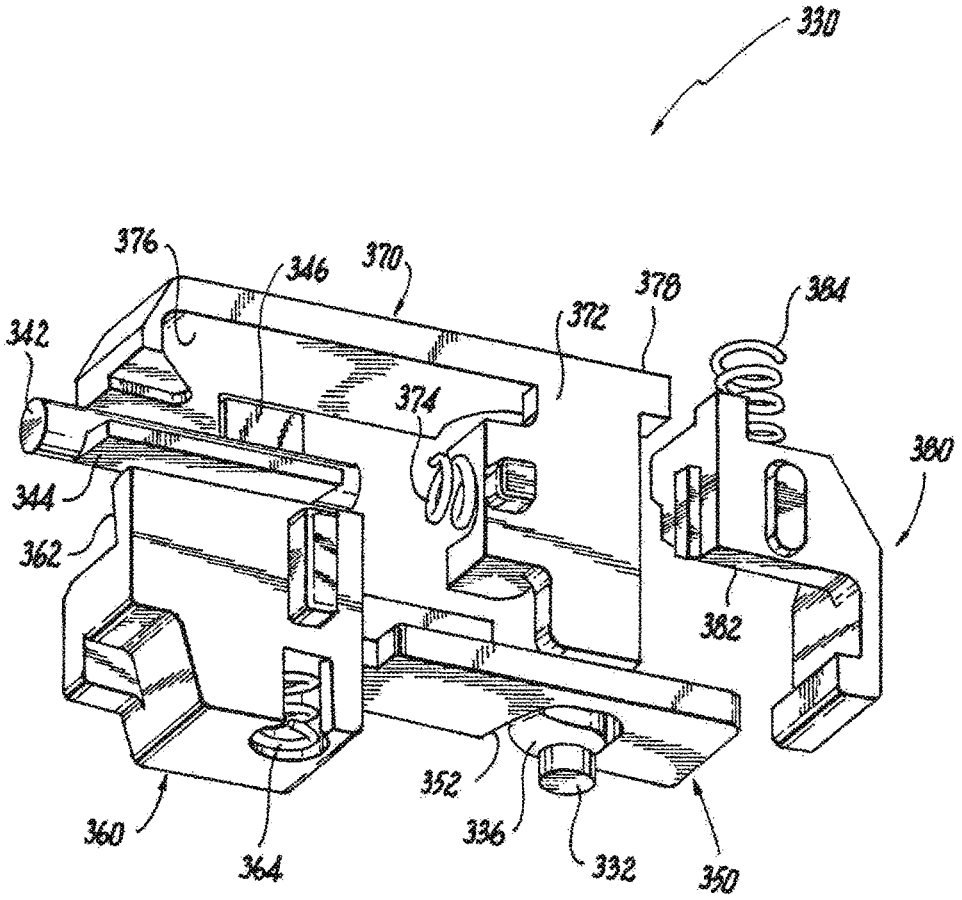
FIG. 23 is a bottom perspective view of the tamper resistant cartridge of FIG. 21.

The second slider 360 includes a floor 362 used to block the opening 311 in the housing 310 providing access to a female connector member, e.g., female connector member 222 within the base 212 of the receptacle 200 or 250, and a spring 364 used to normally bias the second slider 360 so that the floor 362 blocks access to the female connector member. The third slider 370 includes a floor 372, seen in FIGS. 19 and 21, used to block the opening 313 in the housing 310 providing access to a female connector member, e.g., female connector member 222 within the base 212 of the receptacle 200 or 250, and a spring 374 used to normally bias the third slider 370 so that the floor 372 blocks the opening in the housing 310 to block access to the female connector member. The first slider 350 is an intermediate slider used to cause movement of the second slider 360. The fourth slider 380 is used to block a portion of the T-shaped opening 217 in the receptacle cover 216 and operates when two horizontal prongs are inserted into the receptacle 200 or 250 as will be described below.

In operation, and referring to FIGS. 18-23 and inserting a plug having a vertical prong and horizontal prong, when the vertical prong of a plug is inserted into T-shaped slot 217 and a horizontal prong is inserted into the horizontal slot 218 in cover 216 of receptacle 200 or 250, each prong applies a force to each respective shutter 334 or 344. The force applied to the first shutter 334 causes the first shutter to rotate in an inward direction, i.e., to rotate into the housing 310, so that the first shutter arm 332 rotates. Similarly, the force applied to the second shutter 344 causes the second shutter to rotate in an inward direction, i.e., to rotate into the housing 310, so that the second shutter arm 342 rotates. Rotation of the shutter arm 332 causes cam 336 of shutter arm 332 to rotate in an upward direction where the cam 336 engages a wall 352 of the first slider 350 causing the first slider to move in a direction toward the second slider 360. As the first slider 350 moves toward second slider 360, camming surface 354 of the first slider 350 engages camming surface 366 of the second slider 360 causing the second slider to move in a direction away from shutter 344 so that the floor 362 on the second slider moves away from the horizontal opening 311 in the housing 310. Moving the floor 362 away from the opening 311 in the housing 310 permits the prong of the plug to pass through the cartridge 300. Rotation of the shutter arm 342 causes cam 346, seen in FIG. 22, of shutter arm 342 to rotate in an upward direction where the cam 346 engages a wall 376, seen in FIGS. 21 and 23, in the third slider 370 and moves the third slider in a direction away from shutter 334. Moving the third slider 370 in a direction away from the shutter 334 causes the floor 372, seen in FIGS. 21 and 23, on the third slider 370 to move away from the T-shaped opening 313 in the housing 310. Moving the floor 372 away from the opening 313 in the housing 310 permits the prong of the plug to pass through the cartridge 300.

In the event the prongs on the plug inserted into the receptacle 200 or 250 are both horizontal plugs, the same operational steps described above apply. In addition, as the horizontal prong is inserted into the T-shaped opening 217 in cover 216 of receptacle 200 or 250, a portion of the prong engages a camming surface 382 on the fourth slider 380 causing the fourth slider 380 to move in a direction away from the center of the housing 310 compressing spring 384. The fourth slider 380 is free to move within the housing 310 because when third slider 370 slides in a direction away from the shutter 334 a stop 378 on the third slider releases the fourth slider to move within the housing 310. The fourth slider 380 then unblocks a portion 313*a* of the T-shaped opening 313 seen in FIG. 18.

It is noted that having movement of one shutter 334 or 344 causing the movement of a floor 362 or 372 blocking the horizontal opening 311 or the T-shaped opening 313 on the opposite side from the shutter ensures that both prongs of a plug are to be inserted at the same time in order to activate the tamper resistant assembly.

When the plug is removed from the receptacle 200 or 250, the compressed springs 364 and 376 moves the respective sliders 360 or 370. More specifically, spring 364 pushes second slider 360 in a direction toward the center of the housing so that the floor 362 blocks the opening 311 in the housing 310 and thus access to the female connector members 220 or 222 within the housing 110. Spring 376 pushes third slider 370 in a direction toward shutter 334 so that the floor 374 blocks the opening 313 in the housing 310 and thus access to the female connector members 220 or 222 within the base 212. The movement of the second and third sliders 360 and 370 also causes the cams 336 and 346 to rotate in the opposite direction. The reverse rotation of the cams causes the shutter arms 332 and 342 to rotate causing the shutters 334 and 344 to rotate to their normal position blocking the horizontal openings 217 and 218 in the cover 216 of the receptacle 200 or 250, thus resetting the tamper resistant assembly. Further, in the event both prongs on the plug inserted into the receptacle 200 or 250 are horizontal prongs, when the plug is removed from the receptacle, the prong in the T-shaped opening 217 disengages from the fourth slider 380 which releases the compression force of the spring 384 and moves the slider 380 in a direction of the center of the housing where the stop 378 again engages the fourth slider 380 and the fourth slider 380 again blocks the portion 313*a* of the T-shaped opening 313 in the housing 310.

Figure 24:
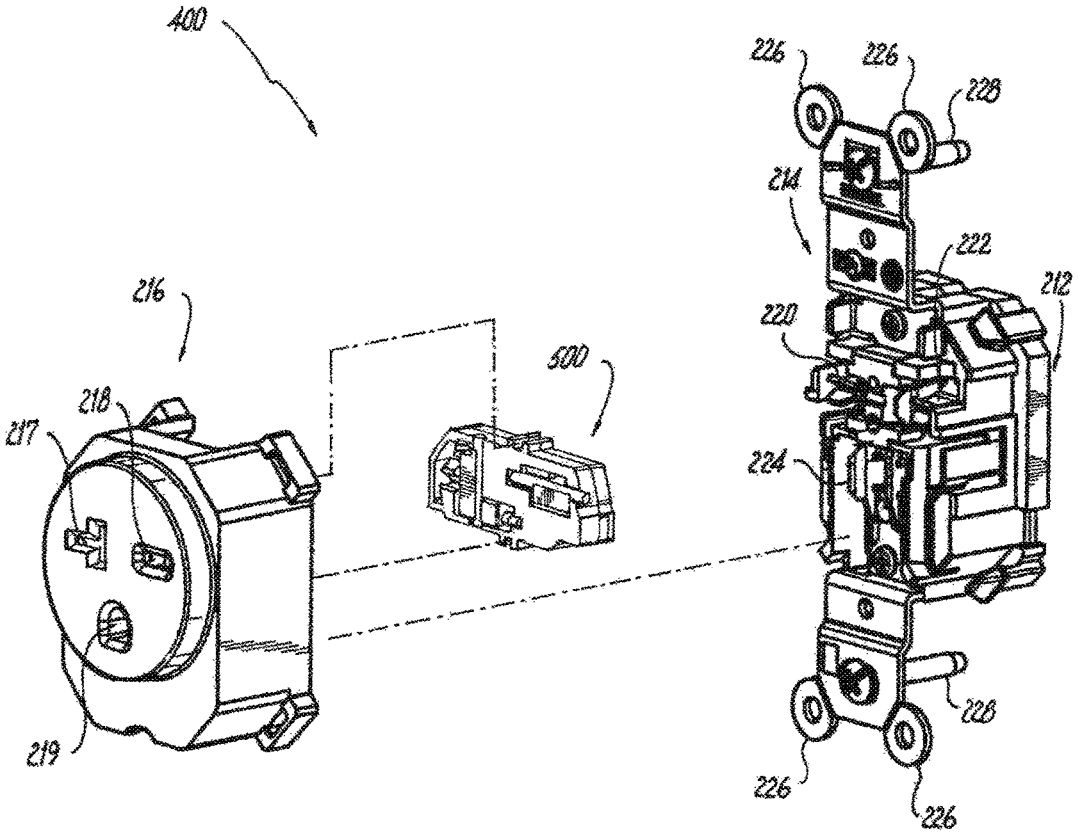
FIG. 24 is an exploded perspective view of another exemplary electrical device according to the present disclosure, illustrating a single receptacle having a T-shaped prong slot and a horizontal prong slot, and incorporating another exemplary embodiment of the tamper resistant cartridge according to the present disclosure.

Referring to FIG. 24, a single receptacle 400 according another exemplary embodiment according to the present disclosure is shown. In this exemplary embodiment, the receptacle 400 includes a base 212, a base bridge assembly 214, and a cover 216 that are similar to the base, base bridge assembly and cover described above. The base supports a single set of female connector members 220 and 222. The base bridge assembly 214 includes one female connector member 224 for receiving one ground plug, and the cover 216 includes a single T-shaped slot 217, a single horizontal slot 218 and a single U-shaped ground slot 219. The single receptacle 400 also includes a single tamper resistant cartridge 500 associated with the female connector members 420 and 422.

Figure 25:
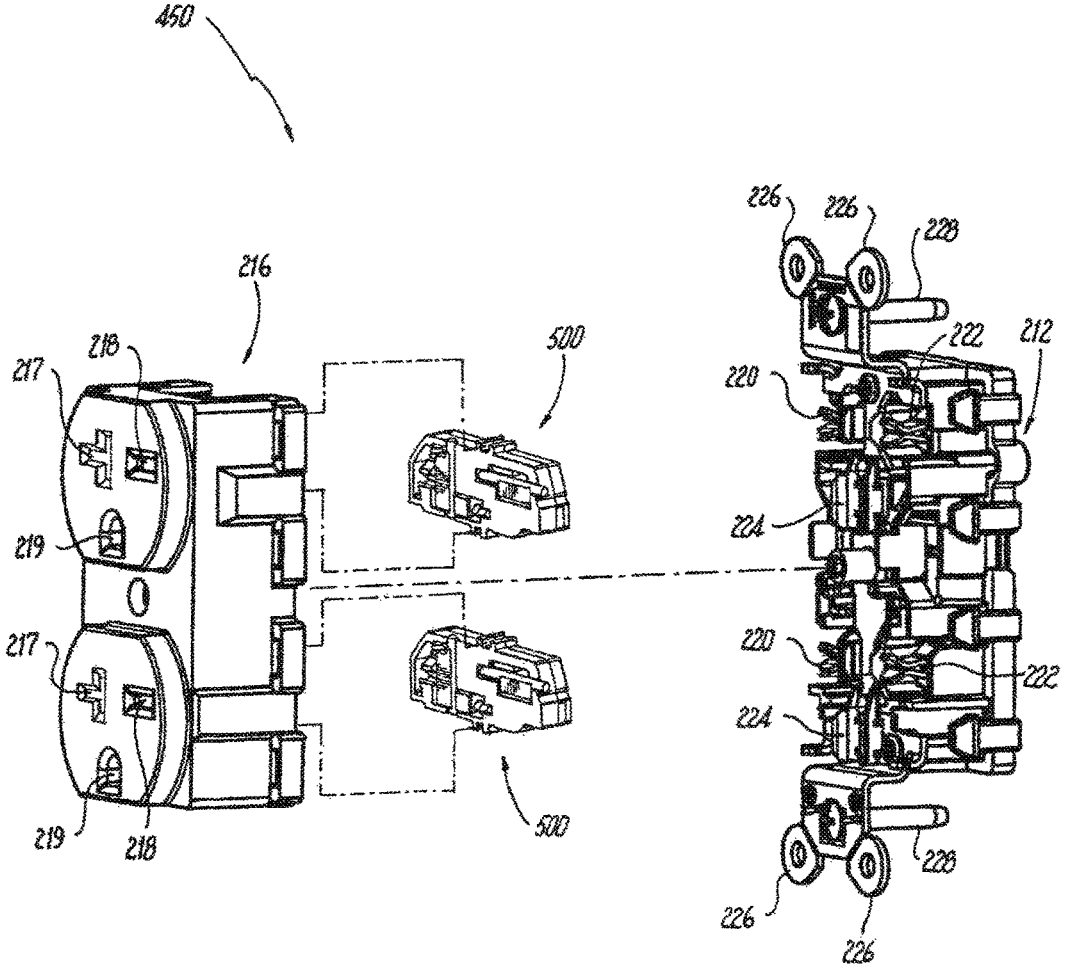
FIG. 25 is an exploded perspective view of another exemplary electrical device according to the present disclosure, illustrating a duplex receptacle having a T-shaped prong slot and a horizontal prong slot in each receptacle, and incorporating the tamper resistant cartridge of FIG. 24 in each receptacle.

Referring to FIG. 25, a duplex receptacle 450 according another exemplary embodiment according to the present disclosure is shown. In this exemplary embodiment, the receptacle 450 includes a base 212, a base bridge assembly 214, and a cover 216 that are similar to the base, base bridge assembly and cover described above. In this exemplary configuration, each half of the duplex receptacle 450 also includes a tamper resistant cartridge 500 associated with the female connector members 220 and 222. The base 452 supports two sets of female connector members 220 and 222. The base bridge assembly 214 includes two female connector members 224 for receiving two ground plugs. Each half of the cover 216 forming the duplex receptacle includes a set slots comprising a single T-shaped slot 217, a single horizontal slot 218 and a single U-shaped ground slot 219.

Figure 26:
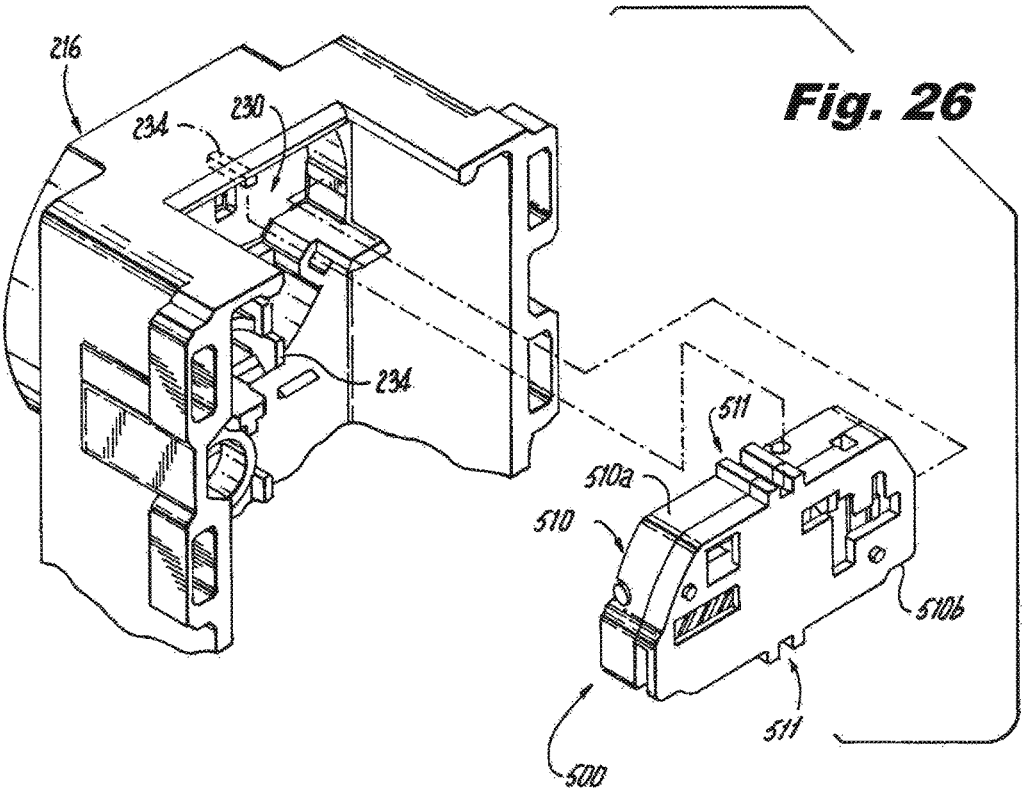
FIG. 26 is an exploded rear perspective view of a portion of the duplex receptacle of FIG. 25, illustrating the tamper resistant cartridge positioned for insertion into the cover of the duplex receptacle.
Figure 27:
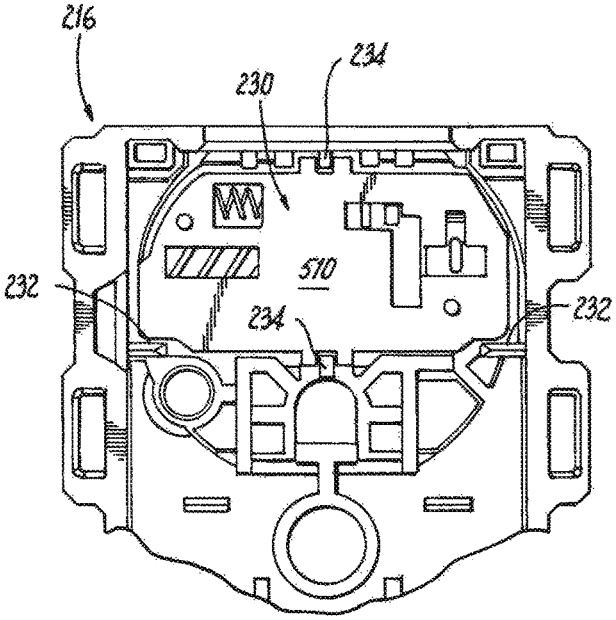
FIG. 27 is a rear elevation view of the portion of the duplex receptacle of FIG. 26, illustrating the tamper resistant cartridge positioned within the cover of the duplex receptacle.

Referring to FIGS. 26 and 27, each half of the duplex receptacle cover 216 includes a recess 230 adjacent the single T-shaped slot 217 and the single horizontal slot 218. The recess 230 is configure and dimensioned to receive a tamper resistant cartridge 500. More specifically, the recess 230 is shaped to receive the housing 510 of the cartridge 500, as shown. The recess 230 includes a ledge 232 on each end of the recess that supports the cartridge. In a center portion of the recess are two rails 234 that receive tracks 511 on the housing 510 of the cartridge 500 which align the cartridge relative to the slots 217 and 219.

Figure 28:
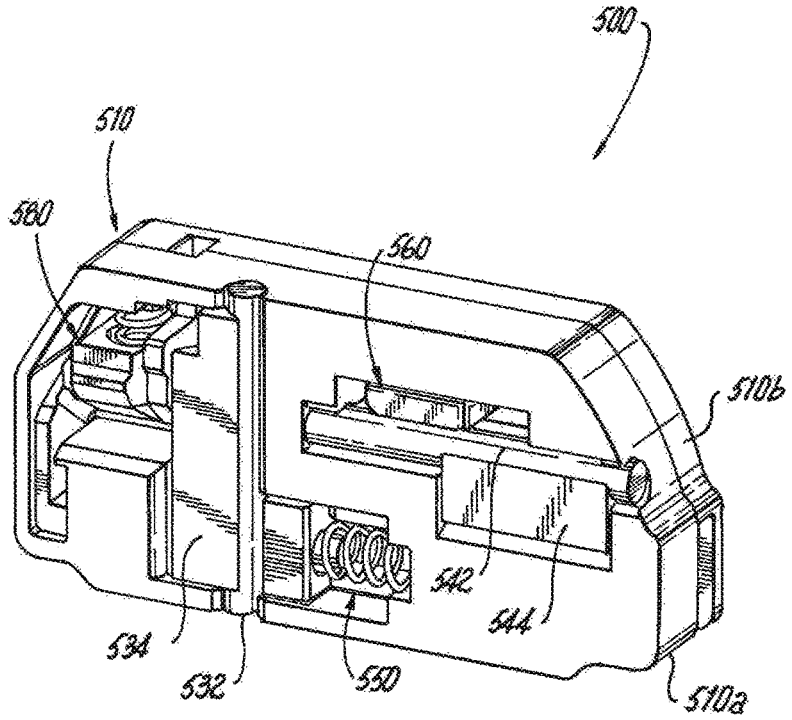
FIG. 28 is a front perspective view of the exemplary embodiment of the tamper resistant cartridge in FIGS. 24 and 25.
Figure 29:
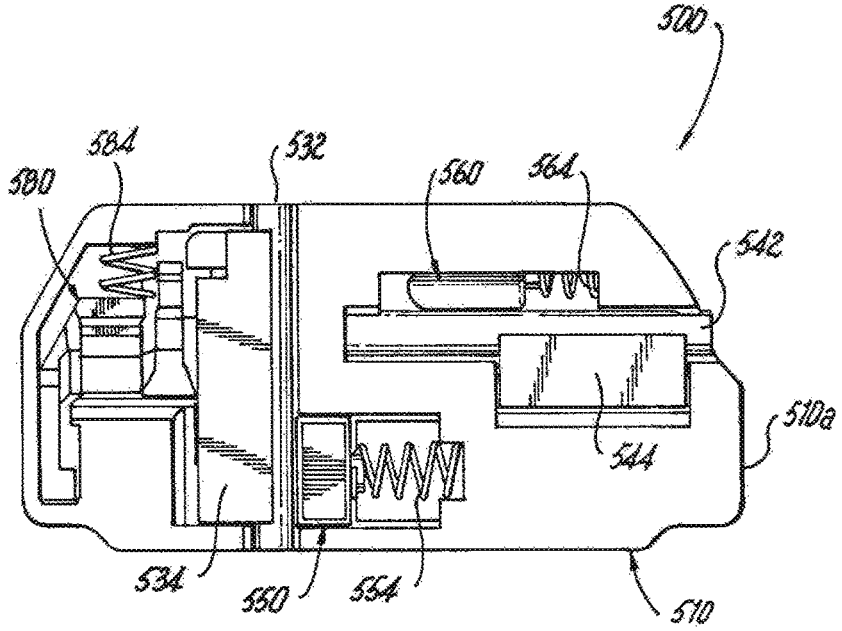
FIG. 29 is a front elevation view of the tamper resistant cartridge of FIG. 28.
Figure 30:
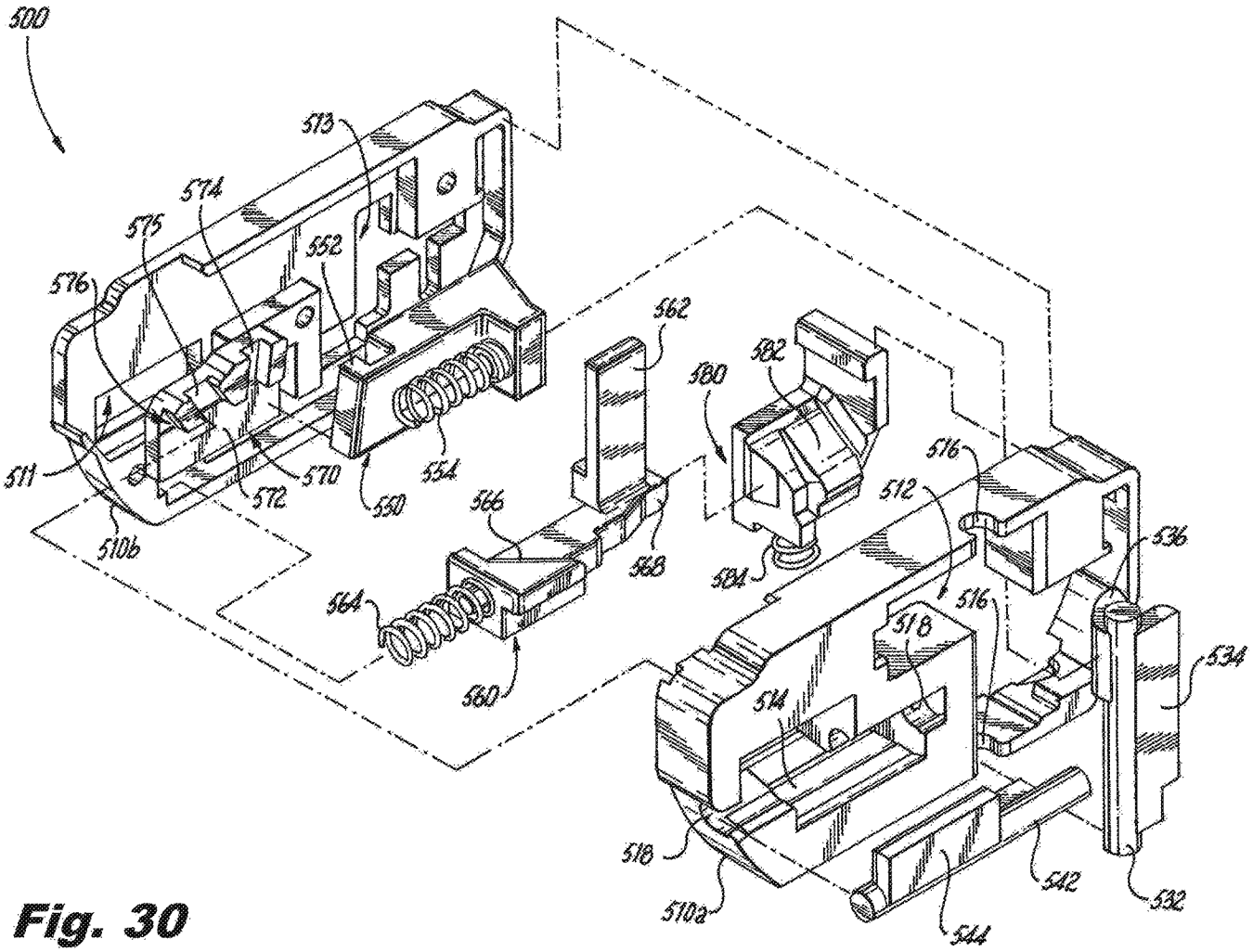
FIG. 30 is an exploded perspective view of the tamper resistant cartridge of FIG. 28.
Figure 31:
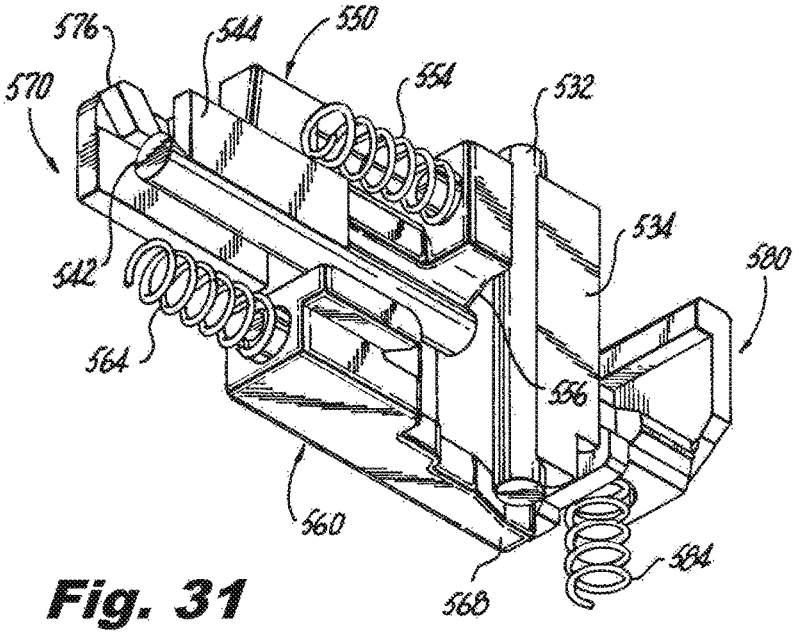
FIG. 31 is a front perspective view of the tamper resistant cartridge of FIG. 28 without a housing and illustrating the tamper resistant assembly in a blocking or protection position.
Figure 32:
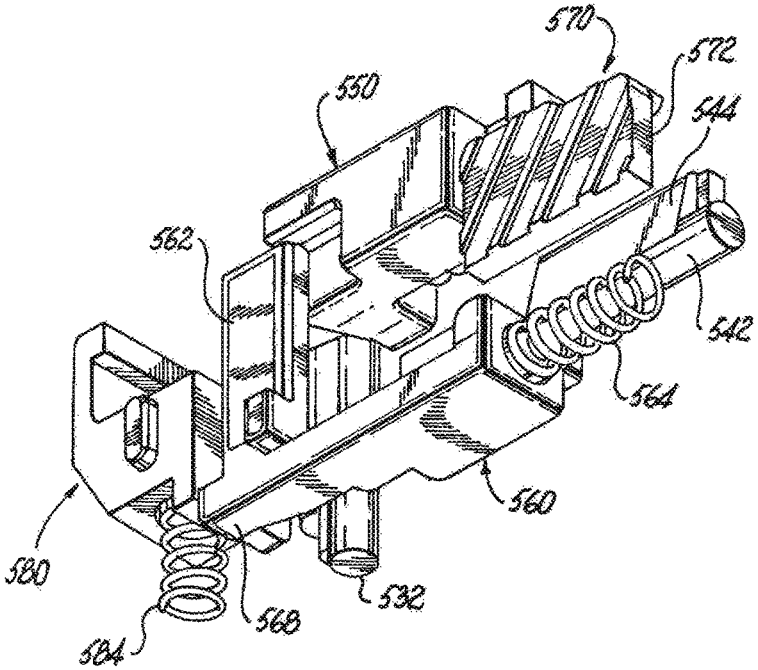
FIG. 32 is a rear perspective view of the tamper resistant cartridge of FIG. 31.

As seen in FIGS. 28-30, the cartridge 500 includes a housing 510 and a tamper resistant assembly 530. The housing 510 in this exemplary embodiment has two housing portions a first housing portion 510*a* and a second housing portion 510*b* which include and when joined form a number of chambers or cavities to support components of the tamper resistant assembly 530 as will be described. For example, the first housing portion 510*a* of housing 510 includes a first shutter chamber 512 and a second shutter chamber 514. The first housing portion 510*a* of housing 510 also includes a plurality of notches 516 and 518 where the shutter arms of the tamper resistant assembly rest. The second housing portion 510*b* of housing 510 includes openings or slots 511 and 513, e.g., a horizontal opening or a T-shaped opening, that permit a prong of a plug to pass through the housing 510.

The tamper resistant assembly 530 includes a first shutter arm 532, a second shutter arm 542, a first slider 550, a second slider 560, and third slider 570 and a fourth slider 580. The shutter arms and sliders are interconnected such that access to the female connector members 220 and 220 in the base 212 of the receptacle are normally blocked by the sliders and access to the female connector members 220 and 222 within the base 212 is selectively permitted upon proper activation of the tamper resistant assembly 530 via the first and second shutter arms 532 and 542.

Figure 33:
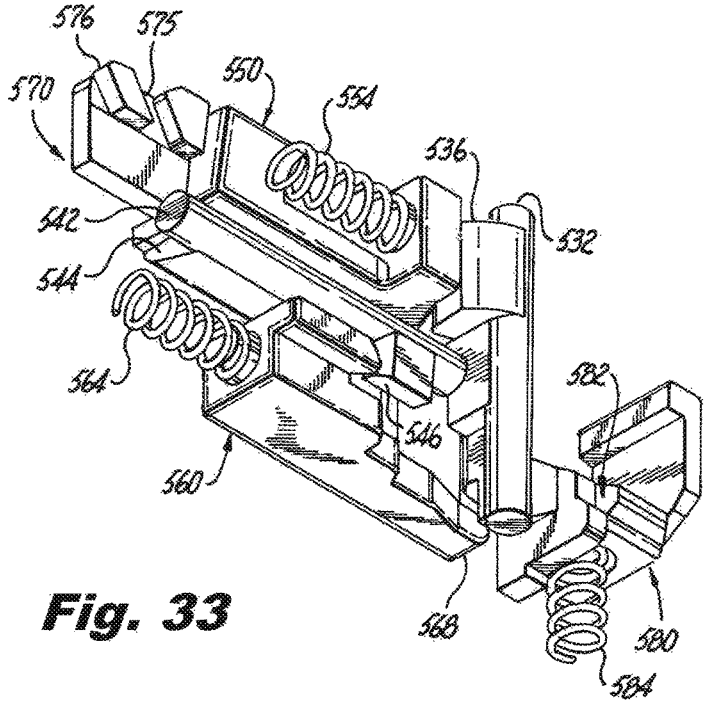
FIG. 33 is a front perspective view of the tamper resistant cartridge of FIG. 28 without a housing and illustrating the tamper resistant assembly in a pass-through position.
Figure 34:
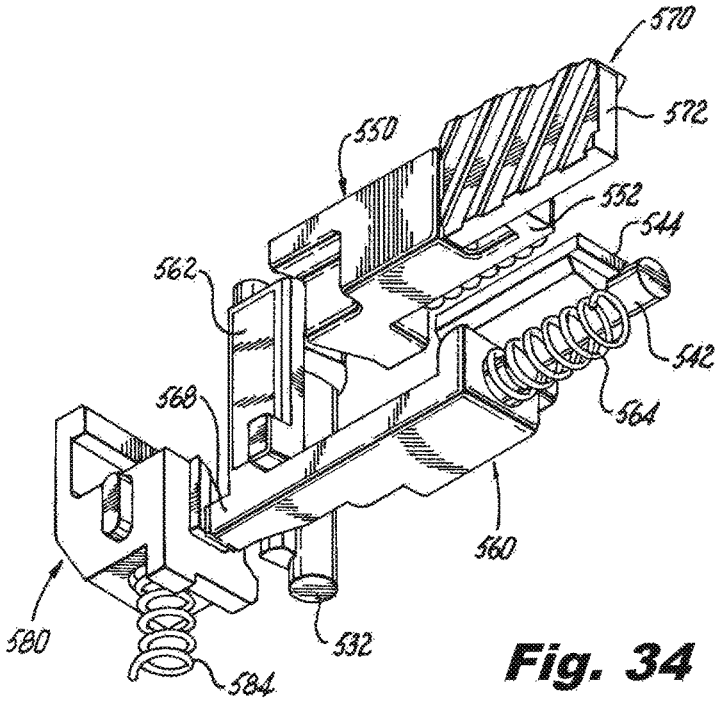
FIG. 34 is a rear perspective view of the tamper resistant cartridge of FIG. 33.

The first shutter arm 532 has a shutter 534 attached to or integrally formed into the shutter arm 532 and a first cam 536, seen in FIGS. 30 and 33, attached to or integrally formed into the first shutter arm 532. The first shutter arm 532 rests within notches 516 in the first housing portion 510*a* of housing 510 so that the first shutter arm can pivot or rotate within the notches 516. The shutter 534 is positioned on the shutter arm 532 so that it would be adjacent the T-shaped slot 217 in the cover 216 of the receptacle 400 or 450. The shutter 534 is provided to activate the tamper resistant assembly 530 to unblock access to a female connector member 220 or 222 within the receptacle base 212, and to selectively permit a prong of a plug to pass through the cartridge 500 via opening 513 in the second housing portion 510*b* of housing 510 to mate with a female connector member. The second shutter arm 542 has a shutter 544 attached to or integrally formed into the shutter arm 542. The second shutter arm 542 rests within notches 518 in the first housing portion 510*a* of housing 510 so that the second shutter arm can pivot or rotate within the notches 518. The second shutter 544 is positioned on the shutter arm 542 so that it would be adjacent the horizontal slot 218 in the cover 216 of the receptacle 400 or 450. The shutter 544 is also provided to activate the tamper resistant assembly 530 to unblock access to a female connector member 220 or 222 within the receptacle base 212, and to selectively permit a prong of a plug to pass through the cartridge 500 via opening 511 in the second housing portion 510*b* of the housing 510 to mate with a female connector member. The first shutter 534 is orientated within the housing 510 such that it is substantially perpendicular to the second shutter 544, as shown in FIG. 30. This arrangement of the shutters 534 and 544 permits the tamper resistant cartridge 500 to work with two horizontal prongs typically associated with a 15 amp, 250 volt rated plug, or with a vertical prong and a horizontal prong typically associated with a 20 amp, 250 volt rated plug.

Figure 35:
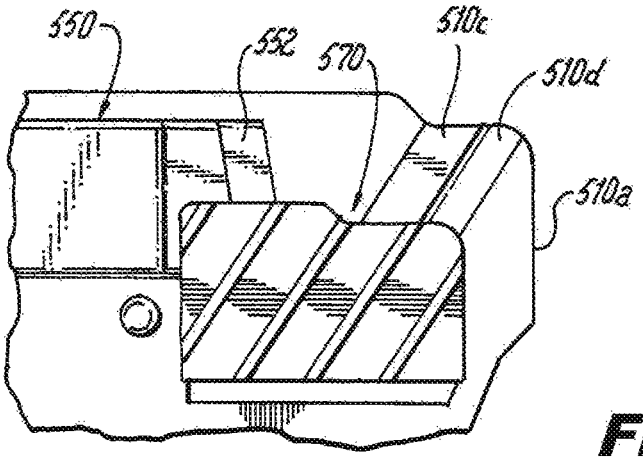
FIGS. 35-37 are elevation views of a portion of a tamper resistant assembly and housing of the tamper resistant cartridge of FIG. 28, illustrating a sequence of movement of a third slider of the tamper resistant assembly moving from the blocking position in FIG. 35 and ending in the pass-through position in FIG. 37.
Figure 36:
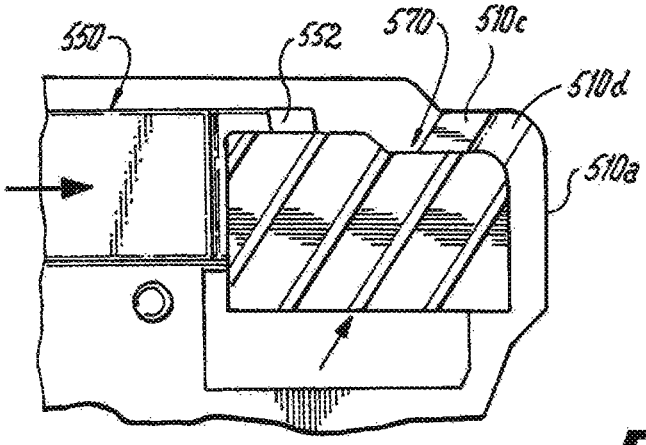
Figure 37:
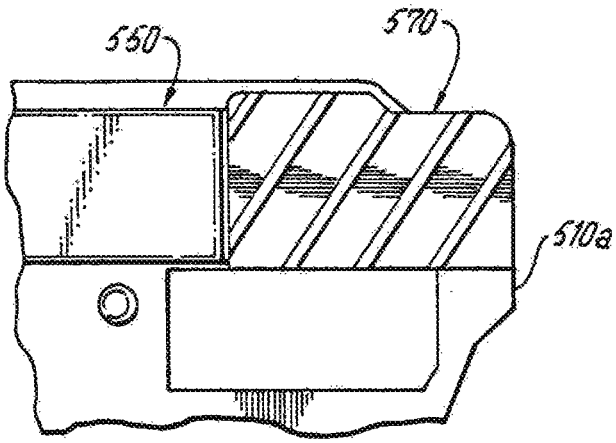

Continuing to refer to FIG. 30, the second slider 560 includes a floor 562 used to block access to the opening 513 in the second housing portion 510*b* of housing 510 providing access to a female connector member, e.g., female connector member 222 within the base 212 of the receptacle 400 or 450. A spring 564 coupled to the second slider 560 is used to normally bias the second slider so that the floor 562 blocks access to the opening 513 and thus the female connector member. The third slider 570 includes a floor 572 that is used to block the opening 511 in the second housing portion 510*b* of housing 510 providing access to a female connector member, e.g., female connector member 222 within the base 212 of the receptacle 400 or 450. The third slider 570 has a track 574 that is slidably coupled to a rail 552 on the first slider 550. The third slider 570 is also slidably coupled to the housing portion 510*a*. More specifically, the third slider 570 includes a track 575 and a rail 576 that slide within or along a corresponding track 510*c* and rail 510*d* in the housing 510, as seen in FIGS. 35-37. The first slider 550 is an intermediate slider that is operatively coupled to the third slider 570 via the track 574 and rail 552, as noted above, and is used to cause movement of the third slider 570 between a position blocking the opening 511 in the second housing portion 510*b* of housing 510, and a position permitting access to the opening 511. The first slider 550 includes a spring 554 that is used to normally bias the first slider toward the shutter 534 so that the floor 572 in the third slider blocks access to the opening 511 and thus the female connector member. The fourth slider 580 is used to block a portion of the T-shaped opening 217 in the receptacle cover 216 and operates when two horizontal prongs are inserted into the receptacle 400 or 450 as will be described below.

In operation, and referring to FIGS. 30-37, when a prong of a plug is inserted into T-shaped slot 217 and horizontal slot 218 in cover 216 of receptacle 400 or 450, each prong applies a force to each respective shutter 534 or 544. The force applied to the first shutter 534 causes the first shutter to rotate in an inward direction, i.e., to rotate into the housing 510, so that the first shutter arm 532 rotates. Similarly, the force applied to the second shutter 544 causes the second shutter to rotate in an inward direction, i.e., to rotate into the housing 510, so that the second shutter arm 542 rotates. Rotation of the shutter arm 532 causes cam 536 of shutter arm 532 to rotate in an upward direction where the cam 536 engages cam surface 556 on the first slider 550 causing the first slider 550 to move in a direction toward the third slider 570. As the first slider 550 moves toward the third slider 370, the spring 554 compresses and the rail 552 coupling the first slider to the third slider causes diagonal motion of the third slider 570 within the track 510*d* and along rail 510*c* of the housing 510, seen in the flow of FIGS. 35-37, such that the third slider moves in a direction away from the opening 511 in the housing so that the floor 572 on the third slider 570 moves away from the horizontal opening 511. Moving the floor 572 away from the opening 511 in the housing 510 permits the prong of the plug to pass through the cartridge 500. Rotation of the shutter arm 542 causes cam 546, seen in FIG. 33, of shutter arm 542 to rotate in an upward direction where the cam 546 engages a cam surface 566, seen in FIG. 30, in the second slider 560 and moves the second slider 560 in a direction away from shutter 534. Moving the second slider 560 in a direction away from the shutter 534 compresses the spring 564 and causes the floor 562, seen in FIGS. 32 and 34, on the second slider 560 to move away from the T-shaped opening 513 in the housing 510. Moving the floor 562 away from the opening 513 in the second housing portion 510*b* of housing 510 permits the prong of the plug to pass through the cartridge 500.

In the event the prongs on the plug inserted into the receptacle 400 or 450 are both horizontal plugs, the same operational steps described above apply. In addition, as the horizontal prong is inserted into the T-shaped opening 217 in cover 216 of receptacle 400 or 450, a portion of the prong engages a camming surface 582 on the fourth slider 580 causing the fourth slider to move in a direction away from the center of the housing 510 compressing spring 584. The fourth slider 580 is free to move within the housing 510 because when the second slider 560 slides in a direction away from the shutter 534 a stop 568 on the second slider 560 releases the fourth slider 580 to move within the housing 510. The fourth slider 580 then unblocks a portion 513*a* of the T-shaped opening 513 in the second housing portion 510*b*.

It is noted that having movement of one shutter 534 or 544 causing the movement of a floor 562 or 572 blocking the horizontal opening 511 or the T-shaped opening 513 on the opposite side from the shutter ensures that both prongs of a plug are to be inserted at the same time in order to activate the tamper resistant assembly.

When the plug is removed from the receptacle 400 or 450, the compressed springs 554 and 564 move the respective sliders 550 or 560. More specifically, spring 554 pushes the slider 550 in a direction toward the shutter 534 so that the floor 572 in the third slider 570 returns to the blocking position, seen in FIG. 31, blocking the opening 511 in the second housing portion 510*b* of housing 510 and thus access to the female connector members 220 or 222 within the base 212. Spring 564 pushes second slider 560 in a direction toward shutter 534 so that the floor 562 returns to the blocking position, seen on FIG. 31, blocking the opening 513 in the second housing portion 510*b* of housing 510 and thus access to the female connector members 220 or 222 within the base 212. The movement of the first and second sliders 550 and 560 also causes the cams 536 and 546 to rotate in the opposite direction. The reverse rotation of the cams causes the shutter arms 532 and 542 to rotate causing the shutters 534 and 544 to rotate to their normal position blocking the horizontal openings 217 and 218 in the cover 216 of the receptacle 400 or 450, thus resetting the tamper resistant assembly. Further, in the event both prongs on the plug inserted into the receptacle 400 or 450 are horizontal prongs, when the plug is removed from the receptacle, the prong in the T-shaped opening 217 disengages from the fourth slider 580 which releases the compression force of the spring 584 and moves the fourth slider 580 in a direction of the center of the housing where the stop 568 of the second slider 560 again engages the fourth slider 580 and the fourth slider again blocks the portion 513*a* of the T-shaped opening 513 in the second housing portion 510*b*.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. An electrical receptacle comprising:

a base having a first connector member and a second connector member, each capable of supplying electrical power;

a cover having a first horizontal line phase slot aligned with the first connector member and a second horizontal line phase slot aligned with the second connector member; and a first tamper resistant cartridge disposed between the first and second connector members and the first and second line phase slots, the first tamper resistant cartridge including:

a first shutter assembly including:

a first shutter aligned with the first horizontal line phase prong slot; and a first slider aligned with the second connector member that normally blocks access to the second connector member;

a second shutter assembly including:

a second shutter aligned with the second horizontal line phase prong slot; and a second slider aligned with the first connector member that normally blocks access to the first connector member;

wherein rotation of the first shutter causes the first slider to move to a position that enables access to the second connector member, and wherein rotation of the second shutter causes the second slider to move to a position that enables access to the first connector member.

2. The electrical receptacle according to claim 1, wherein the base is configured as a single receptacle base and the cover is configured as a single receptacle cover.

3. The electrical receptacle according to claim 1, wherein the first shutter assembly is interrelated with the second shutter assembly such that when each shutter assembly is activated at the same time access from the first and second line phase slots to the first and second connector members is permitted.

4. The electrical receptacle according to claim 1, wherein the first tamper resistant cartridge further comprises a first housing, and wherein the first shutter assembly and the second shutter assembly are positioned with the first housing.

5. The electrical receptacle according to claim 1, wherein the base is configured as a duplex receptacle base and the cover is configured as a duplex receptacle cover, wherein the base further comprises a third connector member and a fourth connector member each capable of supplying electrical power, wherein the cover further comprises a third horizontal line phase slot aligned with the third connector member and a fourth horizontal line phase slot aligned with the fourth connector member;

wherein the electrical receptacle further comprises a second tamper resistant cartridge disposed between the third and fourth connector members and the third and fourth line phase slots, the second tamper resistant cartridge including:

a third shutter assembly including:

a third shutter aligned with the third horizontal line phase slot; and a third slider aligned with the fourth connector member that normally blocks access to the fourth connector member;

a fourth shutter assembly including:

a fourth shutter aligned with the fourth horizontal line phase slot; and a fourth slider aligned with the third connector member that normally blocks access to the third connector member; and wherein rotation of the third shutter causes the third slider to move to a position that enables access to the fourth connector member and rotation of the fourth shutter causes the fourth slider to move to a position that enables access to the third connector member.

6. The electrical receptacle according to claim 5, wherein the second tamper resistant cartridge further comprises a second housing, and wherein the third shutter assembly and the fourth shutter assembly are positioned with the second housing.

7. The electrical receptacle according to claim 5, wherein the third shutter assembly is interrelated with the fourth shutter assembly such that when each shutter assembly is activated at the same time access from the third and fourth line phase slots to the third and fourth connector members is permitted.

8. A tamper resistant cartridge for electrical receptacles, the cartridge comprising:

a housing having a first elongated horizontal opening and a second elongated horizontal opening; and a tamper resistant assembly within the housing and including:

a first shutter assembly having a first shutter aligned with the first elongated horizontal opening, and a first slider aligned with the second elongated horizontal opening that normally blocks access through the housing from second elongated horizontal opening;

a second shutter assembly having a second shutter aligned with the second elongated horizontal opening, and a second slider aligned with the first elongated horizontal opening that normally blocks access through the housing from the first elongated horizontal opening;

wherein rotation of the first shutter causes the first slider to move to a position that permits access through the housing from second elongated horizontal opening, wherein rotation of the second shutter causes the second slider to move to a position that permits access through the housing from the first elongated horizontal opening.

9. The cartridge according to claim 8, wherein the first shutter assembly is interrelated with the second shutter assembly such that when each shutter assembly is activated at substantially the same time the tamper resistant assembly is activated to permit access through the housing.

10. A tamper resistant cartridge for electrical receptacles, the cartridge comprising:

a housing having a first opening that permits a first blade of a plug to pass into the housing, a second opening aligned with the first opening that permits the first blade to pass through the housing, a third opening that permits a second blade of a plug to pass into the housing and a fourth opening aligned with the third opening that permits the second blade to pass through the housing; and a tamper resistant assembly within the housing and positioned between the first opening and the second opening and between the third opening and the fourth opening, the tamper resistant assembly including:

a first shutter assembly having a first shutter aligned with the first opening, and a first slider aligned with the fourth opening that normally blocks access through the housing from the fourth opening; and a second shutter assembly having a second shutter aligned with the third opening, and a second slider aligned with the second opening that normally blocks access through the housing from the second opening;

wherein rotation of the first shutter causes the first slider to move to a position that permits access through the housing from the third opening and the fourth opening, and wherein rotation of the second shutter causes the second slider to move to a position that permits access through the housing from the first opening and the second opening.

11. The cartridge according to claim 10, wherein the first shutter assembly is interrelated with the second shutter assembly such that when each shutter assembly is activated at substantially the same time the first and second sliders move to a position where the second and fourth openings are not blocked such that access through the housing is permitted.

12. An electrical receptacle comprising:

a base having a plurality of connector members including a first connector member and a second connector member, each of the plurality of connector members capable of supplying electrical power;

a cover having plurality of line phase slots aligned with the plurality of connector members including a first horizontal line phase slot and a second horizontal line phase slot, wherein the first horizontal line phase slot is aligned with the first connector member and the second horizontal line phase slot is aligned with the second connector member;

a yoke secured to the base and used to secure the electrical receptacle to an electrical box; and at least one tamper resistant cartridge disposed between the plurality of line phase slots and the plurality of connector members, including a first tamper resistant cartridge disposed between the first and second horizontal line phase slots and the first and second connector members, the first tamper resistant cartridge including:

a first shutter assembly including:

a first shutter aligned with the first horizontal line phase slot; and a first slider aligned with the second connector member that normally blocks access to the second connector member; and a second shutter assembly including:

a second shutter aligned with the second horizontal line phase slot; and a second slider aligned with the first connector member that normally blocks access to the first connector member;

wherein rotation of the first shutter causes the first slider to move to a position that enables access to the second connector member, and wherein rotation of the second shutter causes the second slider to move to a position that enables access to the first connector member.

13. The electrical receptacle according to claim 12, wherein the first tamper resistant cartridge further comprises a first housing, and wherein the first shutter assembly and the second shutter assembly are positioned with the first housing.

14. The electrical receptacle according to claim 12, wherein the first shutter assembly is interrelated with the second shutter assembly such that when each shutter assembly is activated at substantially the same time access from the first and second line phase slots to the first and second connector members is permitted.

15. The electrical receptacle according to claim 12, wherein the first tamper resistant cartridge further comprises:

a first housing having a first horizontal opening that permits a first blade of a first plug to pass into the first housing and a second opening aligned with the first horizontal opening that permits the first blade to pass through the first housing, and a third horizontal opening that permits a second blade of the first plug to pass into the first housing and a fourth opening aligned with the third horizontal opening that permits the second blade to pass through the first housing.

16. The electrical receptacle according to claim 12, wherein the base is configured as a single receptacle base and the cover is configured as a single receptacle cover.

17. The electrical receptacle according to claim 12, wherein the base is configured as a duplex receptacle base and the cover is configured as a duplex receptacle cover, wherein the base further comprises a third connector member and a fourth connector member each capable of supplying electrical power, wherein the cover further comprises a third horizontal line phase slot aligned with the third connector member and a fourth horizontal line phase slot aligned with the fourth connector member;

wherein the at least one tamper resistant cartridge comprises a second tamper resistant cartridge disposed between the third and fourth connector members and the third and fourth line phase slots, the second tamper resistant cartridge including:

a third shutter assembly including:

a third shutter aligned with the third horizontal line phase slot; and a third slider aligned with the fourth connector member that normally blocks access to the fourth connector member;

a fourth shutter assembly including:

a fourth shutter aligned with the fourth horizontal line phase slot; and a fourth slider aligned with the third connector member that normally blocks access to the third connector member; and wherein rotation of the third shutter causes the third slider to move to a position that enables access to the fourth connector member and rotation of the fourth shutter causes the fourth slider to move to a position that enables access to the third connector member.

18. The electrical receptacle according to claim 17, wherein the second tamper resistant cartridge further comprises a second housing, and wherein the third shutter assembly and the fourth shutter assembly are positioned with the second housing.

19. The electrical receptacle according to claim 17, wherein the third shutter assembly is interrelated with the fourth shutter assembly such that when each shutter assembly is activated at substantially the same time access from the third and fourth line phase slots to the third and fourth connector members is permitted.

20. The electrical receptacle according to claim 17, wherein the second tamper resistant cartridge further comprises:

a second housing having a fifth horizontal opening that permits a first blade of a second plug to pass into the second housing and a sixth opening aligned with the fifth horizontal opening that permits the first blade to pass through the second housing, and a seventh horizontal opening that permits a second blade of the second plug to pass into the second housing and a eight opening aligned with the seventh horizontal opening that permits the second blade to pass through the second housing.

* * * * *